US009181938B2

(12) United States Patent
Vos et al.

(10) Patent No.: US 9,181,938 B2
(45) Date of Patent: Nov. 10, 2015

(54) TANK DAMPENING DEVICE

(71) Applicant: BLACK & DECKER INC., Newark, DE (US)

(72) Inventors: Stephen J. Vos, Jackson, TN (US); Scott D. Craig, Jackson, TN (US)

(73) Assignee: BLACK & DECKER INC., Newark, DE (US)

( * ) Notice: Subject to any disclaimer, the term of this patent is extended or adjusted under 35 U.S.C. 154(b) by 0 days.

(21) Appl. No.: 14/493,484

(22) Filed: Sep. 23, 2014

(65) Prior Publication Data

US 2015/0016953 A1 Jan. 15, 2015

Related U.S. Application Data

(63) Continuation of application No. 13/609,359, filed on Sep. 11, 2012, now Pat. No. 8,851,229.

(60) Provisional application No. 61/534,015, filed on Sep. 13, 2011, provisional application No. 61/533,993, filed on Sep. 13, 2011, provisional application No. 61/534,001, filed on Sep. 13, 2011, provisional application No. 61/534,009, filed on Sep. 13, 2011, provisional application No. 61/534,046, filed on Sep. 13, 2011.

(51) Int. Cl.

| | |
|---|---|
| ***F16F 7/00*** | (2006.01) |
| ***F04B 39/00*** | (2006.01) |
| ***F04B 23/10*** | (2006.01) |
| ***F04B 35/06*** | (2006.01) |
| ***F04B 39/12*** | (2006.01) |
| ***F04B 41/02*** | (2006.01) |
| ***F04D 19/00*** | (2006.01) |
| ***F04D 29/66*** | (2006.01) |
| ***F04B 39/06*** | (2006.01) |

(52) U.S. Cl.

CPC ..... *F04B 39/0033* (2013.01); *F04B 23/10* (2013.01); *F04B 35/06* (2013.01); *F04B 39/0027* (2013.01); *F04B 39/0055* (2013.01); *F04B 39/0061* (2013.01); *F04B 39/066* (2013.01); *F04B 39/121* (2013.01); *F04B 41/02* (2013.01); *F04D 19/00* (2013.01); *F04D 29/668* (2013.01); *Y10S 181/403* (2013.01); *Y10T 29/49238* (2015.01); *Y10T 137/7039* (2015.04)

(58) Field of Classification Search

CPC ..... F04B 39/0027; F04B 39/0055; F04B 39/121; F04B 39/0061; F04B 23/10; F04B 35/06; F04B 41/02; F04D 19/00; F04D 29/668; Y10T 29/49238

USPC ..... 181/198, 200, 278, 282, 403; 417/312

See application file for complete search history.

(56) References Cited

U.S. PATENT DOCUMENTS

| | | | |
|---|---|---|---|
| 1,694,218 | A | 6/1924 | Hazard |
| 1,924,654 | A | 3/1930 | Petersen |

(Continued)

FOREIGN PATENT DOCUMENTS

JP 09250457 A * 9/1997 ..... F04B 41/02

*Primary Examiner* — Jeremy Luks

(74) *Attorney, Agent, or Firm* — Rhonda L. Barton

(57) ABSTRACT

A compressor assembly that has a compressed air tank having a vibration absorption member. The vibration absorption member can exert a pressure on a portion of the compressed air tank. A method of controlling sound emitted from a compressor assembly, by using a vibration absorber which applies a force against the compressed gas tank. Controlling the sound level of the compressed gas tank is accomplished by absorbing vibration from the compressed gas tank by which exerting a pressure on a portion of the compressed gas tank.

11 Claims, 30 Drawing Sheets

(56) References Cited

U.S. PATENT DOCUMENTS

| | | | |
|---|---|---|---|
| 2,059,894 | A | 6/1933 | Newman |
| 2,136,098 | A | 7/1937 | Browne |
| 2,312,596 | A | 2/1940 | Smith |
| 2,343,952 | A | 2/1943 | Branstrom |
| 2,375,442 | A | 5/1945 | Sandberg |
| D181,459 | S | 11/1957 | Bullock |
| 3,525,606 | A | 8/1970 | Bodine |
| 3,537,544 | A | 11/1970 | King et al. |
| 3,710,094 | A | 1/1973 | Monte et al. |
| 3,930,558 | A | 1/1976 | Schnell et al. |
| 3,955,900 | A | 5/1976 | Vinci |
| 3,978,919 | A | 9/1976 | Fachbach et al. |
| 3,980,912 | A | 9/1976 | Panza |
| 4,190,402 | A | 2/1980 | Meece et al. |
| 4,264,282 | A | 4/1981 | Crago |
| 4,289,630 | A | 9/1981 | Schmidt, Jr. et al. |
| 4,302,224 | A | 11/1981 | McCombs et al. |
| D263,216 | S | 3/1982 | Maher |
| 4,342,573 | A | 8/1982 | McCombs et al. |
| 4,401,418 | A | 8/1983 | Fritchman |
| 4,460,319 | A | 7/1984 | Ashikian |
| 4,553,903 | A | 11/1985 | Ashikian |
| 4,566,800 | A | 1/1986 | Bodine |
| 4,722,673 | A | 2/1988 | Grime et al. |
| 4,907,546 | A | 3/1990 | Ishii et al. |
| 4,928,480 | A | 5/1990 | Oliver et al. |
| 4,950,133 | A | 8/1990 | Sargent |
| 4,988,268 | A | 1/1991 | Kurihara |
| 5,020,973 | A | 6/1991 | Lammers |
| 5,133,475 | A | 7/1992 | Sharp |
| 5,137,434 | A | 8/1992 | Wheeler et al. |
| D335,407 | S | 5/1993 | Ngian et al. |
| 5,213,484 | A | 5/1993 | Hashimoto et al. |
| 5,311,625 | A | 5/1994 | Barker et al. |
| 5,336,046 | A | 8/1994 | Hashimoto et al. |
| 5,407,330 | A | 4/1995 | Rimington et al. |
| 5,417,258 | A | 5/1995 | Privas |
| 5,507,159 | A | 4/1996 | Cooksey |
| 5,526,228 | A | 6/1996 | Dickson et al. |
| 5,620,370 | A | 4/1997 | Umai et al. |
| 5,678,543 | A | 10/1997 | Bower |
| 5,725,361 | A | 3/1998 | Dantlgraber |
| 6,023,938 | A | 2/2000 | Taras et al. |
| 6,091,160 | A | 7/2000 | Kouchi et al. |
| 6,099,268 | A | 8/2000 | Pressel |
| 6,100,599 | A | 8/2000 | Kouchi et al. |
| 6,145,974 | A | 11/2000 | Shinada et al. |
| D437,581 | S | 2/2001 | Aruga et al. |
| D437,825 | S | 2/2001 | Imai |
| 6,206,654 | B1 | 3/2001 | Cassidy |
| D444,796 | S | 7/2001 | Morgan |
| D444,797 | S | 7/2001 | Davis et al. |
| 6,257,842 | B1 | 7/2001 | Kawasaki et al. |
| 6,331,740 | B1 | 12/2001 | Morohoshi et al. |
| D454,357 | S | 3/2002 | Diels |
| 6,357,338 | B2 | 3/2002 | Montgomery |
| 6,362,533 | B1 | 3/2002 | Morohoshi et al. |
| 6,378,468 | B1 | 4/2002 | Kouchi et al. |
| 6,378,469 | B1 | 4/2002 | Hiranuma et al. |
| 6,386,833 | B1 | 5/2002 | Montgomery |
| D461,196 | S | 8/2002 | Buck |
| 6,428,283 | B1 | 8/2002 | Bonior |
| 6,428,288 | B1 | 8/2002 | King |
| 6,431,839 | B2 | 8/2002 | Gruber et al. |
| 6,435,076 | B2 | 8/2002 | Montgomery |
| 6,447,257 | B2 | 9/2002 | Orschell |
| 6,454,527 | B2 | 9/2002 | Nishiyama et al. |
| 6,474,954 | B1 | 11/2002 | Bell et al. |
| 6,554,583 | B1 | 4/2003 | Pressel |
| 6,682,317 | B2 | 1/2004 | Chen |
| 6,751,941 | B2 | 6/2004 | Edelman et al. |
| 6,784,560 | B2 | 8/2004 | Sugimoto et al. |
| 6,790,012 | B2 | 9/2004 | Sharp et al. |
| 6,814,659 | B2 | 11/2004 | Cigelske, Jr. |
| D499,431 | S | 12/2004 | Chen |
| 6,952,056 | B2 | 10/2005 | Brandenburg et al. |
| 6,962,057 | B2 | 11/2005 | Kurokawa et al. |
| 6,991,436 | B2 | 1/2006 | Beckman et al. |
| 6,998,725 | B2 | 2/2006 | Brandenburg et al. |
| D517,009 | S | 3/2006 | Xiao |
| D521,929 | S | 5/2006 | Xiao |
| D531,193 | S | 10/2006 | Caito |
| 7,147,444 | B2 | 12/2006 | Cheon |
| D536,348 | S | 2/2007 | Bass |
| D536,708 | S | 2/2007 | Bass |
| 7,189,068 | B2 | 3/2007 | Thomas, Jr. et al. |
| D551,141 | S | 9/2007 | Canitano |
| 7,283,359 | B2 | 10/2007 | Bartell et al. |
| D566,042 | S | 4/2008 | Yamasaki et al. |
| D568,797 | S | 5/2008 | Elwell |
| D572,658 | S | 7/2008 | Yamamoto et al. |
| 7,392,770 | B2 | 7/2008 | Xiao |
| 7,398,747 | B2 | 7/2008 | Onodera et al. |
| 7,398,855 | B2 | 7/2008 | Seel |
| 7,400,501 | B2 | 7/2008 | Bartell et al. |
| D576,723 | S | 9/2008 | Achen |
| 7,430,992 | B2 | 10/2008 | Murakami et al. |
| 7,452,256 | B2 | 11/2008 | Kasai et al. |
| 7,491,264 | B2 | 2/2009 | Tao et al. |
| D588,987 | S | 3/2009 | Kato |
| D589,985 | S | 4/2009 | Steinfels |
| D593,032 | S | 5/2009 | Wang et al. |
| 7,563,077 | B2 | 7/2009 | Santa Ana |
| D600,205 | S | 9/2009 | Imai |
| 7,597,340 | B2 | 10/2009 | Hirose et al. |
| 7,614,473 | B2 | 11/2009 | Ono et al. |
| 7,643,284 | B2 | 1/2010 | Nakamura |
| 7,678,165 | B2 | 3/2010 | Tingle et al. |
| 7,707,711 | B2 | 5/2010 | Bartell et al. |
| 7,743,739 | B2 | 6/2010 | Kochi et al. |
| 7,779,792 | B2 | 8/2010 | Kubo et al. |
| 7,779,793 | B2 | 8/2010 | Ito et al. |
| 7,854,517 | B2 | 12/2010 | Tsubura |
| 2004/0084247 | A1 | 5/2004 | Kishida |
| 2005/0058556 | A1* | 3/2005 | Cremer et al. ..... 417/363 |
| 2005/0092544 | A1 | 5/2005 | Lee |
| 2005/0220640 | A1 | 10/2005 | Finkenbinder et al. |
| 2006/0104830 | A1 | 5/2006 | Fields |
| 2006/0104833 | A1 | 5/2006 | Hueppchen |
| 2006/0104834 | A1 | 5/2006 | Stilwell |
| 2006/0104837 | A1 | 5/2006 | Lee et al. |
| 2008/0045368 | A1 | 2/2008 | Nishihara |
| 2008/0053746 | A1 | 3/2008 | Albert et al. |
| 2008/0152518 | A1 | 6/2008 | Stilwell |
| 2009/0016902 | A1 | 1/2009 | Lee et al. |
| 2010/0112929 | A1 | 5/2010 | Iantorno |
| 2010/0225012 | A1 | 9/2010 | Fitton et al. |
| 2010/0226750 | A1 | 9/2010 | Gammack |
| 2010/0226771 | A1 | 9/2010 | Crawford et al. |
| 2010/0226787 | A1 | 9/2010 | Gammack et al. |
| 2010/0317281 | A1 | 12/2010 | Sperandio et al. |
| 2011/0094052 | A1 | 4/2011 | Witter |
| 2011/0095540 | A1 | 4/2011 | Jackson et al. |
| 2011/0182754 | A1 | 7/2011 | Gathers et al. |
| 2013/0064642 | A1 | 3/2013 | Vos et al. |

* cited by examiner

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 65 – 75 | 2.4 - 3.5 | | | | | | | | | | |
| 65 – 75 | | 150 - 250 | | | | | | | | | |
| 65 – 75 | | | 60 - 200 | | | | | | | | |
| 65 – 75 | | | | 50 - 100 | | | | | | | |
| 65 – 75 | 2.4 - 3.5 | 150 - 250 | 60 - 200 | | | | | | | | |
| 65 – 75 | 2.4 - 3.5 | 150 - 250 | | 50 - 100 | | | | | | | |
| 65 – 75 | 2.4 - 3.5 | 150 - 250 | | | 1500 - 3000 | 1.5 - 2.25 | 1.3 - 2 | | | | |
| 65 – 75 | 2.4 - 3.5 | 150 - 250 | | | | | | 2.3 - 8 | 33 - 50 | | |
| 65 – 75 | 2.4 - 3.5 | 150 - 250 | | | | | | | | 1000-1800 | 45 - 65 |

FIG. 17

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 65 – 75 | | | | | 1500 - 3000 | | | | | | |
| 65 – 75 | | | | | | 1.5 - 2.25 | | | | | |
| 65 – 75 | | | | | | | 1.3 - 2 | | | | |
| 65 – 75 | | | | | | | | 2.3 - 8 | | | |
| 65 – 75 | | | | | | | | | 33 - 50 | | |
| 65 – 75 | | | | | | | | | | 1000-1800 | |
| 65 – 75 | 2.4 - 3.5 | 150 - 250 | 60 - 200 | 50 - 100 | | | | | | | 45 - 65 |
| 65 – 75 | | | | | 1500 - 3000 | 1.5 - 2.25 | | | | | |
| 65 – 75 | 2.4 - 3.5 | 150 - 250 | 60 - 200 | 50 - 100 | 1500 - 3000 | 1.5 - 2.25 | 1.3 - 2 | | | | |
| 65 – 75 | 2.4 - 3.5 | 150 - 250 | 60 - 200 | 50 - 100 | 1500 - 3000 | 1.5 - 2.25 | 1.3 - 2 | 2.3 - 8 | 33 - 50 | 1000-1800 | 45 - 65 |

FIG. 18

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 70.5 | 2.9 | | | 71.5 | | | | | | | |
| 70.5 | 2.9 | | | | 2300 | 1.875 | 1.592 | | | | |
| 70.5 | 2.9 | | | | | | | 4.4 | 41 | | |
| 70.5 | 2.9 | | | | | | | | | 1446 | 56.5 |
| 70.5 | 2.9 | 200 | 84.1 | | | | | | | | |
| 70.5 | 2.9 | 200 | | 71.5 | | | | | | | |
| 70.5 | 2.9 | 200 | | | 2300 | 1.875 | 1.592 | | | | |
| 70.5 | 2.9 | 200 | | | | | | 4.4 | 41 | | |
| 70.5 | 2.9 | 200 | | | | | | | | 1446 | 56.5 |
| 70.5 | 2.9 | | 84.1 | | | | | | | | |
| 70.5 | 2.9 | | | 71.5 | | | | | | | |
| 70.5 | 2.9 | | | | 2300 | | | | | | |
| 70.5 | 2.9 | | | | | | | | | 1446 | |
| 70.5 | | 200 | 84.1 | | | | | | | | |
| 70.5 | | 200 | | 71.5 | | | | | | | |
| 70.5 | | 200 | | | 2300 | | | | | | |
| 70.5 | | 200 | | | | | | | | 1446 | |
| 70.5 | | | 84.1 | 71.5 | | | | | | | |
| 70.5 | | | 84.1 | | 2300 | | | | | | |
| 70.5 | | | | | | | | | | 1446 | |

FIG. 19

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 70.5 | 2.9 | 200 | 84.1 | 71.5 | | | | | | | |
| 70.5 | 2.9 | 200 | 84.1 | | 2300 | | | | | | |
| 70.5 | 2.9 | 200 | 84.1 | 71.5 | 2300 | | | | | | |
| 70.5 | 2.9 | 200 | 84.1 | | | 1.875 | | | | | |
| 70.5 | 2.9 | 200 | 84.1 | | | | 1.592 | | | | |
| 70.5 | 2.9 | 200 | 84.1 | 71.5 | 2300 | | | | | | |
| 70.5 | 2.9 | 200 | 84.1 | 71.5 | 2300 | 1.875 | | | | | |
| 70.5 | 2.9 | 200 | 84.1 | 71.5 | 2300 | | 1.592 | | | | |
| 70.5 | 2.9 | 200 | 84.1 | 71.5 | 2300 | 1.875 | 1.592 | | | | |
| 70.5 | 2.9 | 200 | 84.1 | | | | | 4.4 | | | |
| 70.5 | 2.9 | 200 | 84.1 | | | | | | 41 | | |
| 70.5 | 2.9 | 200 | 84.1 | 71.5 | 2300 | 1.875 | 1.592 | 4.4 | | | |
| 70.5 | 2.9 | 200 | 84.1 | 71.5 | 2300 | 1.875 | 1.592 | 4.4 | 41 | | |
| 70.5 | 2.9 | 200 | 84.1 | | | | | | | 1446 | |
| 70.5 | 2.9 | 200 | 84.1 | | | | | | | | 56.5 |
| 70.5 | 2.9 | 200 | 84.1 | 71.5 | 2300 | 1.875 | 1.592 | 4.4 | 41 | 1446 | |
| 70.5 | 2.9 | 200 | 84.1 | 71.5 | 2300 | 1.875 | 1.592 | 4.4 | 41 | 1446 | 56.5 |

FIG. 20

| | Compressor Assembly Performance Data |
|---|---|
| Motor Speed (RPM) | 11200 |
| Pump Speed (RPM) | 2300 |
| Voltage | 120 |
| Air Flow (SCFM) @ 90 psi | 2.9 |
| Current Draw @ 90 psi (amps) | 11.8 |
| Volumetric Efficiency @ 90 psi | 49.6% |
| Motor Torque (lb-in) @ 90 psi | 6.01 |
| Motor Efficiency @ 90 psi | 56.3% |
| Air Flow (SCFM) @ 150 psi | 2.4 |
| Current Draw @ 150 psi (amps) | 12.05 |
| Volumetric Efficiency @ 150 psi | 41.0% |
| Motor Torque (lb-in) @ 150 psi | 6.16 |
| Motor Efficiency @ 150 psi | 56.5% |
| Air Flow (SCFM) @ 200 psi | 2.15 |
| Current Draw @ 200 psi (amps) | 11.88 |
| Volumetric Efficiency @ 200 psi | 36.7% |
| Motor Torque (lb-in) @ 200 psi | 6.06 |
| Motor Efficiency @ 200 psi | 56.4% |
| Cylinder Bore (inches) | 1.875 |
| Cylinder Stroke (inches) | 1.592 |
| Cylinder Swept Volume (cubic inches) | 4.40 |
| Sound Level (dBA) | 70.5 |
| Heat Transfer Rate (BTU/min) | 84.1 |

FIG. 21

TANK DAMPENING DEVICE

CROSS-REFERENCE TO RELATED APPLICATIONS

This patent application claims benefit of the filing date under 35 USC §120 of U.S. patent application Ser. No. 13/609,359 filed Sep. 11, 2012, which claims benefit of the filing date under 35 USC §120 to the following US provisional patent applications: U.S. patent application No. 61/533,993 entitled "Air Ducting Shroud For Cooling An Air Compressor Pump And Motor" filed on Sep. 13, 2011; U.S. provisional patent application No. 61/534,001 entitled "Shroud For Capturing Fan Noise" filed on Sep. 13, 2011; U.S. provisional patent application No. 61/534,009 entitled "Method Of Reducing Air Compressor Noise" filed on Sep. 13, 2011; U.S. provisional patent application No. 61/534,015 entitled "Tank Dampening Device" filed on Sep. 13, 2011; and U.S. provisional patent application No. 61/534,046 entitled "Compressor Intake Muffler And Filter" filed on Sep. 13, 2011.

INCORPORATION BY REFERENCE

This patent application incorporates by reference in its entirety U.S. provisional patent application No. 61/533,993 entitled "Air Ducting Shroud For Cooling An Air Compressor Pump And Motor" filed on Sep. 13, 2011. This patent application incorporates by reference in its entirety U.S. provisional patent application No. 61/534,001 entitled "Shroud For Capturing Fan Noise" filed on Sep. 13, 2011. This patent application incorporates by reference in its entirety U.S. provisional patent application No. 61/534,009 entitled "Method Of Reducing Air Compressor Noise" filed on Sep. 13, 2011. This patent application incorporates by reference in its entirety U.S. provisional patent application No. 61/534,015 entitled "Tank Dampening Device" filed on Sep. 13, 2011. This patent application incorporates by reference in its entirety U.S. provisional patent application No. 61/534,046 entitled "Compressor Intake Muffler And Filter" filed on Sep. 13, 2011.

FIELD OF THE INVENTION

The invention relates to a compressor for air, gas or gas mixtures.

BACKGROUND OF THE INVENTION

Compressors are widely used in numerous applications. Existing compressors can generate a high noise output during operation. This noise can be annoying to users and can be distracting to those in the environment of compressor operation. Non-limiting examples of compressors which generate unacceptable levels of noise output include reciprocating, rotary screw and rotary centrifugal types. Compressors which are mobile or portable and not enclosed in a cabinet or compressor room can be unacceptably noisy. However, entirely encasing a compressor, for example in a cabinet or compressor room, is expensive, prevents mobility of the compressor and is often inconvenient or not feasible. Additionally, such encasement can create heat exchange and ventilation problems. There is a strong and urgent need for a quieter compressor technology.

When a power source for a compressor is electric, gas or diesel, unacceptably high levels of unwanted heat and exhaust gases can be produced. Additionally, existing compressors can be inefficient in cooling a compressor pump and motor. Existing compressors can use multiple fans, e.g. a compressor can have one fan associated with a motor and a different fan associated with a pump. The use of multiple fans adds cost manufacturing difficulty, noise and unacceptable complexity to existing compressors. Current compressors can also have improper cooling gas flow paths which can choke cooling gas flows to the compressor and its components. Thus, there is a strong and urgent need for a more efficient cooling design for compressors.

SUMMARY OF THE INVENTION

In an embodiment, the compressor assembly disclosed herein can have a compressed air tank with a tank dampening member such as a vibration absorption member; and can exhibit a sound level when in a compressing state having a value of 75 dBA or less. The compressor assembly can have a vibration absorption member which exerts a pressure on an internal portion of the compressed air tank. The compressor assembly can have a vibration absorption member which exerts a pressure on a plurality of portions of the compressed air tank. The compressor assembly can have a vibration absorption member which has a plunger absorber that applies a force against a portion of the compressed air tank. The compressor assembly can have a vibration absorption member which has multi-finger absorber that applies a constant force against a portion of the compressed air tank. The compressor assembly can have a vibration absorption member which has an expansion clover absorber that applies a constant force against a portion of the compressed air tank. The compressor assembly can also have a resilient material between the compressed air tank and the vibration absorption member.

In another aspect, a sound level of a compressor assembly can be controlled by a method of controlling sound that is emitted from a compressor assembly having the steps of providing a compressor assembly having a compressed gas tank; providing a vibration absorber which applies a force upon the compressed gas tank; and controlling the sound level of the compressor assembly when in a compressing state to a value in a range of from 65 dBA to 75 dBA. The method of controlling sound emitted from a compressor assembly can also have the step of compressing a gas at a rate in a range of from 2.4 SCFM to 3.5 SCFM. The method of controlling sound emitted from a compressor assembly can also have optionally have of or more of the steps: of operating a motor which drives a pump assembly at a pump speed at a rate in a range of from 1500 rpm to 3000; cooling the compressor assembly with a cooling gas at a rate in the range of from 50 CFM to 100; and compressing a gas to a pressure in a range of from 150 psig to 250 psig.

A compressor assembly can have a means for controlling the sound level of a compressed gas tank by using a means for absorbing vibration from the compressed gas tank which can absorb vibration and is adapted to exert a pressure on a portion of the compressed gas tank. The compressor assembly can have a means for controlling the sound level of a compressed gas tank by using a means for absorbing vibration from the compressed gas tank which exerts a pressure on an inside portion of the compressed gas tank. The compressor assembly can have a means for controlling the sound level of a compressed gas tank by using a means for absorbing vibration from the compressed gas tank which exerts a pressure on a portion of the compressed gas tank in a range of from 45 psi to 60 psi. A compressor assembly can have a means for controlling the sound level of a compressed gas tank by using a means for absorbing vibration from the compressed gas tank which exerts a pressure on an internal portion of the compressed gas tank in a range of from 45 psi to 60 psi. A compressor assembly can have a means for controlling the sound level of a compressed gas wherein a means for absorbing vibration from the compressed gas tank has a cushion member. A compressor assembly can have a means for controlling the sound level of a compressed gas wherein a means for absorbing vibration from the compressed gas tank has a multi-layered cushion member. A compressor assembly can have a means for controlling the sound level of a compressed gas tank wherein a means for absorbing vibration from the compressed gas tank has a compressive member.

BRIEF DESCRIPTION OF THE DRAWINGS

The present invention in its several aspects and embodiments solves the problems discussed above and significantly advances the technology of compressors. The present invention can become more fully understood from the detailed description and the accompanying drawings, wherein:

FIG. 17 is a first table of embodiments of compressor assembly ranges of performance characteristics;

FIG. 18 is a second table of embodiments of compressor assembly ranges of performance characteristics;

FIG. 19 is a first table of example performance characteristics for an example compressor assembly;

FIG. 20 is a second table of example performance characteristics for an example compressor assembly;

FIG. 21 is a table containing a third example of performance characteristics of an example compressor assembly;

Herein, like reference numbers in one figure refer to like reference numbers in another figure.

DETAILED DESCRIPTION OF THE INVENTION

Figure 2:
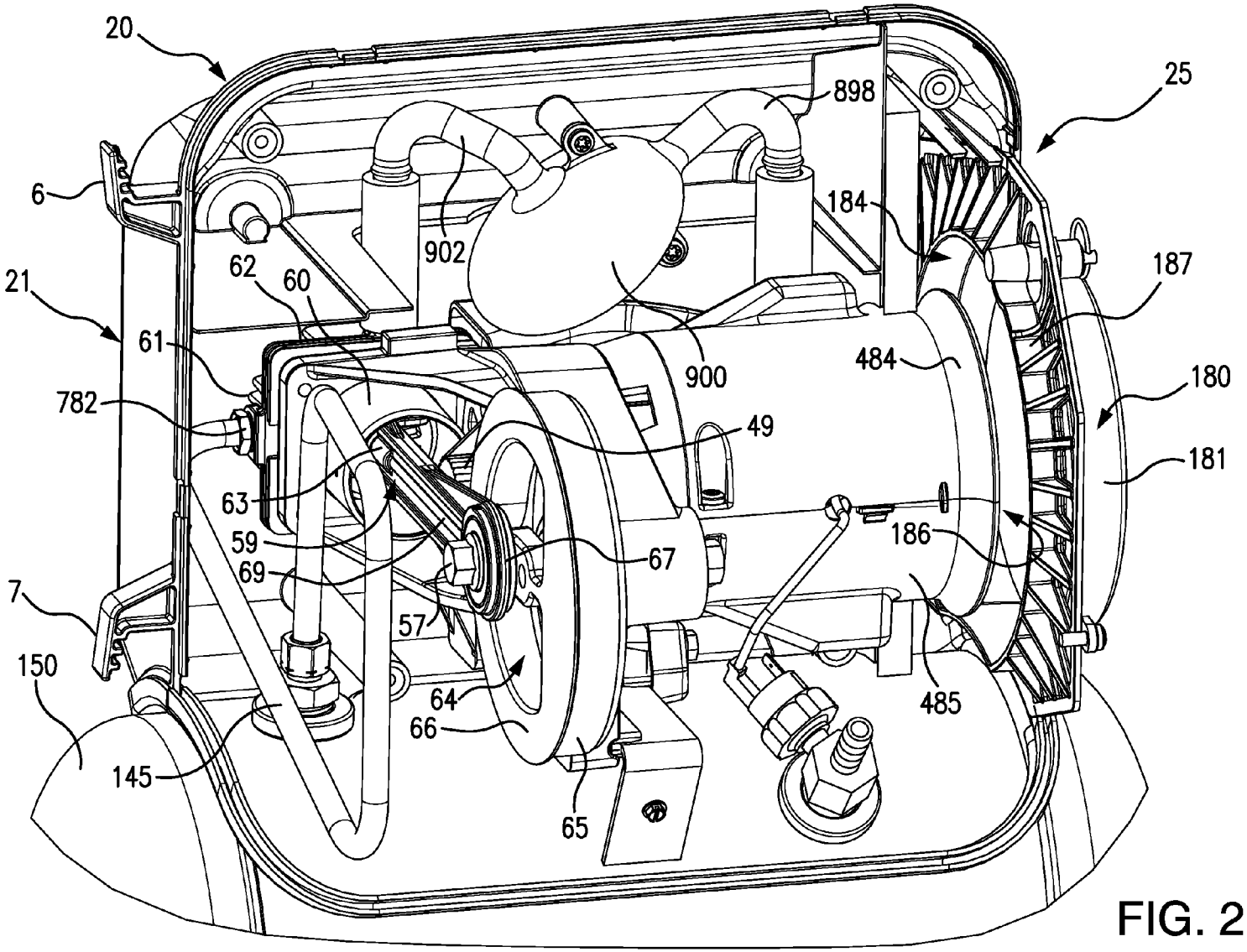
FIG. 2 is a front view of internal components of the compressor assembly.
Figure 3:
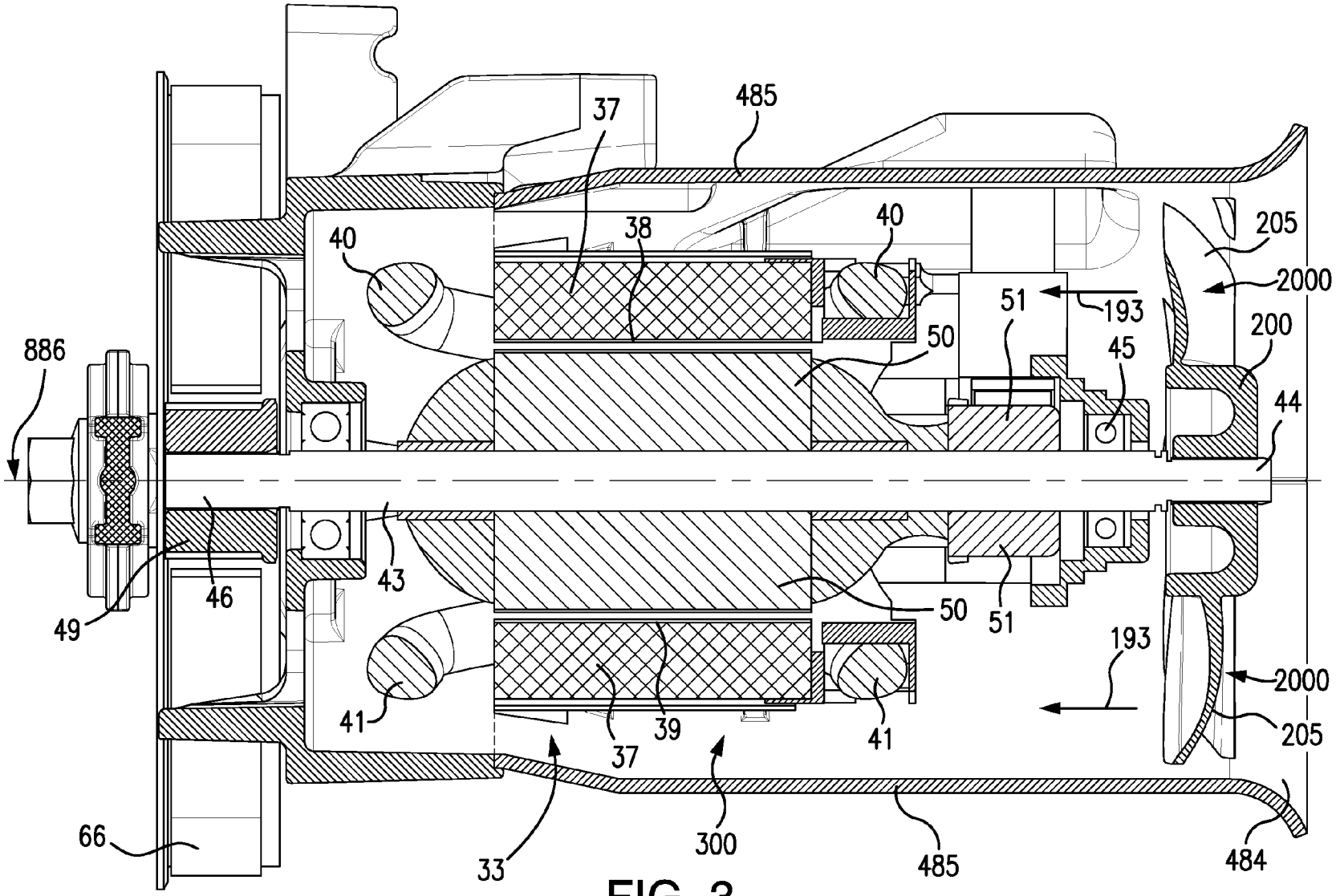
FIG. 3 is a front sectional view of the motor and fan assembly.
Figure 4:
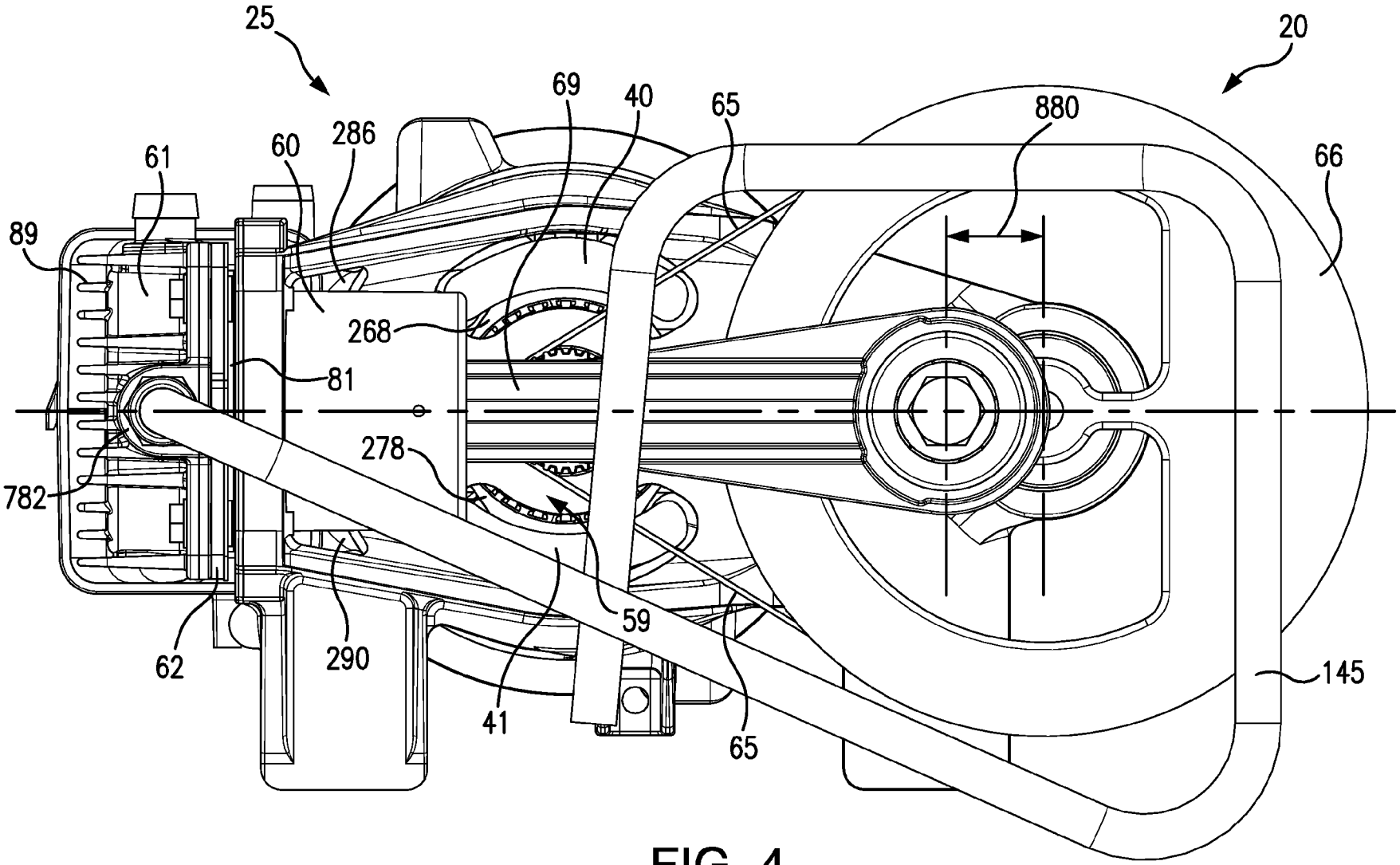
FIG. 4 is a pump-side view of components of the pump assembly.

The invention relates to a compressor assembly which can compress air, or gas, or gas mixtures, and which has a low noise output, effective cooling means and high heat transfer. The inventive compressor assembly achieves efficient cooling of the compressor assembly 20 (FIG. 1) and/or pump assembly 25 (FIG. 2) and/or the components thereof (FIGS. 3 and 4). In an embodiment, the compressor can compress air. In another embodiment, the compressor can compress one or more gases, inert gases, or mixed gas compositions. The disclosure herein regarding compression of air is also applicable to the use of the disclosed apparatus in its many embodiments and aspects in a broad variety of services and can be used to compress a broad variety of gases and gas mixtures.

Figure 1:
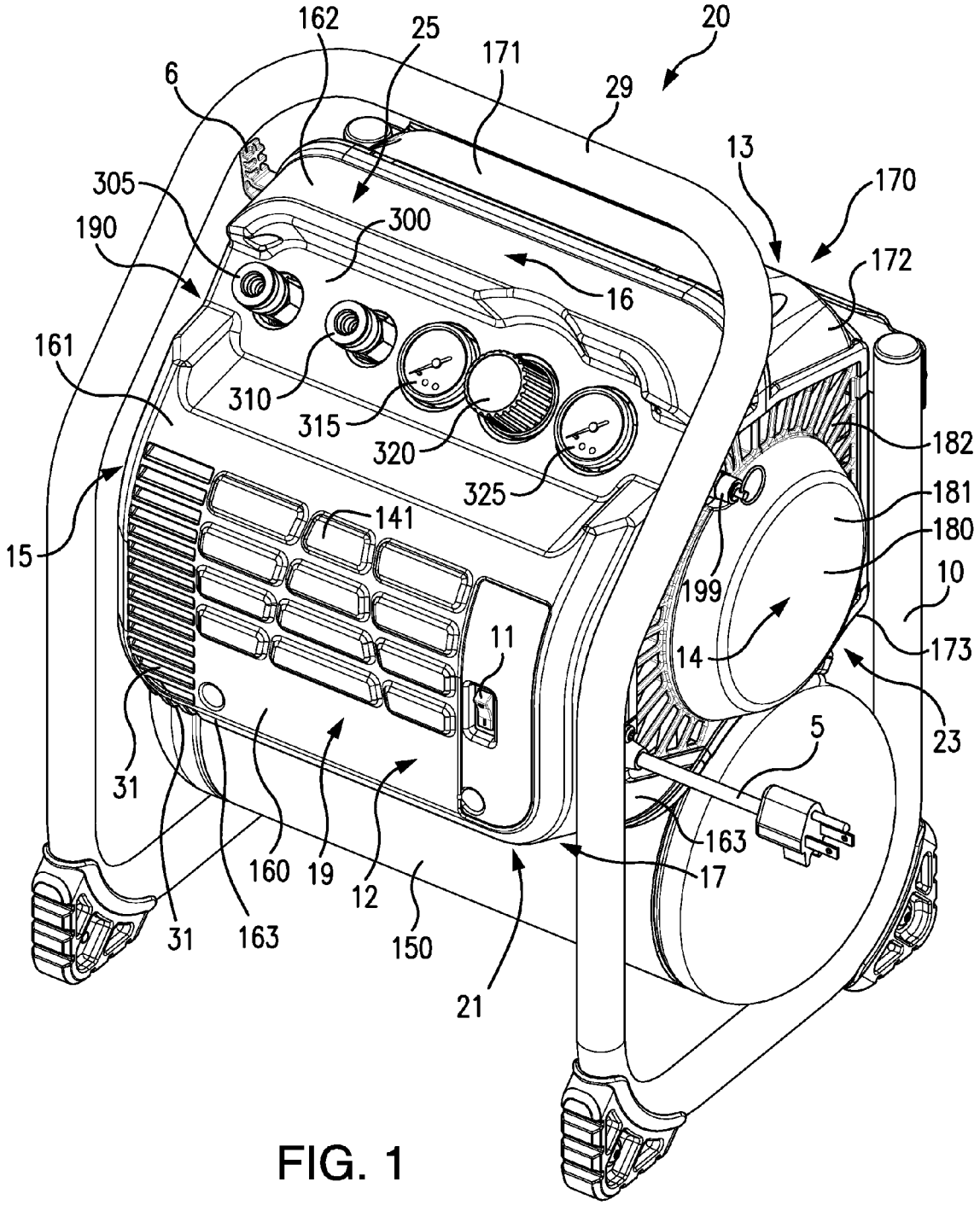
FIG. 1 is a perspective view of a compressor assembly.

FIG. 1 is a perspective view of a compressor assembly 20 shown according to the invention. In an embodiment, the compressor assembly 20 can compress air, or can compress one or more gases, or gas mixtures. In an embodiment, the compressor assembly 20 is also referred to hearing herein as "a gas compressor assembly" or "an air compressor assembly".

The compressor assembly 20 can optionally be portable. The compressor assembly 20 can optionally have a handle 29, which optionally can be a portion of frame 10.

In an embodiment, the compressor assembly 20 can have a value of weight between 15 lbs and 100 lbs. In an embodiment, the compressor assembly 20 can be portable and can have a value of weight between 15 lbs and 50 lbs. In an embodiment, the compressor assembly 20 can have a value of weight between 25 lbs and 40 lbs. In an embodiment, the compressor assembly 20 can have a value of weight of, e.g. 38 lbs, or 29 lbs, or 27 lbs, or 25 lbs, or 20 lbs, or less. In an embodiment, frame 10 can have a value of weight of 10 lbs or less. In an embodiment, frame 10 can weigh 5 lbs, or less, e.g. 4 lbs, or 3 lbs, of 2 lbs, or less.

In an embodiment, the compressor assembly 20 can have a front side 12 ("front"), a rear side 13 ("rear"), a fan side 14 ("fan-side"), a pump side 15 ("pump-side"), a top side 16 ("top") and a bottom side 17 ("bottom").

The compressor assembly 20 can have a housing 21 which can have ends and portions which are referenced herein by orientation consistently with the descriptions set forth above. In an embodiment, the housing 21 can have a front housing 160, a rear housing 170, a fan-side housing 180 and a pump-side housing 190. The front housing 160 can have a front housing portion 161, a top front housing portion 162 and a bottom front housing potion 163. The rear housing 170 can have a rear housing portion 171, a top rear housing portion 172 and a bottom rear housing portion 173. The fan-side housing 180 can have a fan cover 181 and a plurality of intake ports 182. The compressor assembly can be cooled by air flow provided by a fan 200 (FIG. 3), e.g. cooling air stream 2000 (FIG. 3).

In an embodiment, the housing 21 can be compact and can be molded. The housing 21 can have a construction at least in part of plastic, or polypropylene, acrylonitrile butadiene styrene (ABS), metal, steel, stamped steel, fiberglass, thermoset plastic, cured resin, carbon fiber, or other material. The frame 10 can be made of metal, steel, aluminum, carbon fiber, plastic or fiberglass.

Power can be supplied to the motor of the compressor assembly through a power cord 5 extending through the fan-side housing 180. In an embodiment, the compressor assembly 20 can comprise one or more of a cord holder member, e.g. first cord wrap 6 and second cord wrap 7 (FIG. 2).

In an embodiment, power switch 11 can be used to change the operating state of the compressor assembly 20 at least from an "on" to an "off" state, and vice versa. In an "on" state, the compressor can be in a compressing state (also herein as a "pumping state") in which it is compressing air, or a gas, or a plurality of gases, or a gas mixture.

Figure 7:
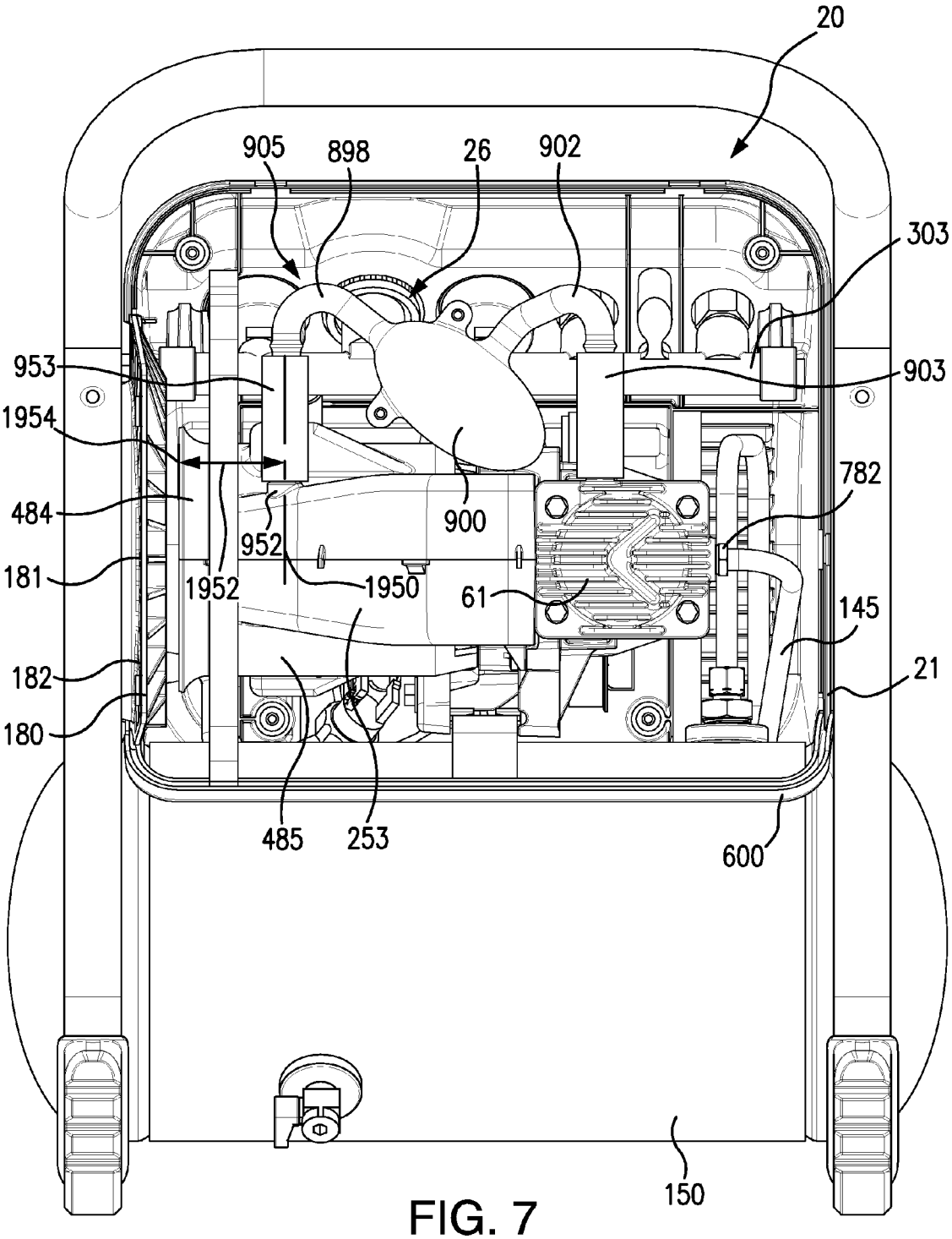
FIG. 7 is a rear view of internal components of the compressor assembly.

In an embodiment, other operating modes can be engaged by power switch 11 or a compressor control system, e.g. a standby mode, or a power save mode. In an embodiment, the front housing 160 can have a dashboard 300 which provides an operator-accessible location for connections, gauges and valves which can be connected to a manifold 303 (FIG. 7). In an embodiment, the dashboard 300 can provide an operator access in non-limiting example to a first quick connection 305, a second quick connection 310, a regulated pressure gauge 315, a pressure regulator 320 and a tank pressure gauge 325. In an embodiment, a compressed gas outlet line, hose or other device to receive compressed gas can be connected the first quick connection 305 and/or second quick connection 310. In an embodiment, as shown in FIG. 1, the frame can be configured to provide an amount of protection to the dashboard 300 from the impact of objects from at least the pump-side, fan-side and top directions.

In an embodiment, the pressure regulator 320 employs a pressure regulating valve. The pressure regulator 320 can be used to adjust the pressure regulating valve 26 (FIG. 7). The pressure regulating valve 26 can be set to establish a desired output pressure. In an embodiment, excess air pressure can be can vented to atmosphere through the pressure regulating valve 26 and/or pressure relief valve 199 (FIG. 1). In an embodiment, pressure relief valve 199 can be a spring loaded safety valve. In an embodiment, the air compressor assembly 20 can be designed to provide an unregulated compressed air output.

In an embodiment, the pump assembly 25 and the compressed gas tank 150 can be connected to frame 10. The pump assembly 25, housing 21 and compressed gas tank 150 can be connected to the frame 10 by a plurality of screws and/or one or a plurality of welds and/or a plurality of connectors and/or fasteners.

The plurality of intake ports 182 can be formed in the housing 21 adjacent the housing inlet end 23 and a plurality of exhaust ports 31 can be formed in the housing 21. In an embodiment, the plurality of the exhaust ports 31 can be placed in housing 21 in the front housing portion 161. Optionally, the exhaust ports 31 can be located adjacent to the pump end of housing 21 and/or the pump assembly 25 and/or the pump cylinder 60 and/or cylinder head 61 (FIG. 2) of the pump assembly 25. In an embodiment, the exhaust ports 31 can be provided in a portion of the front housing portion 161 and in a portion of the bottom front housing portion 163.

The total cross-sectional open area of the intake ports 182 (the sum of the cross-sectional areas of the individual intake ports 182) can be a value in a range of from 3.0 in^2 to 100 in^2. In an embodiment, the total cross-sectional open area of the intake ports 182 can be a value in a range of from 6.0 in^2 to 38.81 in^2. In an embodiment, the total cross-sectional open area of the intake ports 182 can be a value in a range of from 9.8 in^2 to 25.87 in^2. In an embodiment, the total cross-sectional open area of the intake ports 182 can be 12.936 in^2.

In an embodiment, the cooling gas employed to cool compressor assembly 20 and its components can be air (also known herein as "cooling air"). The cooling air can be taken in from the environment in which the compressor assembly 20 is placed. The cooling air can be ambient from the natural environment, or air which has been conditioned or treated. The definition of "air" herein is intended to be very broad. The term "air" includes breathable air, ambient air, treated air, conditioned air, clean room air, cooled air, heated air, non-flammable oxygen containing gas, filtered air, purified air, contaminated air, air with particulates solids or water, air from bone dry (i.e. 0.00 humidity) air to air which is supersaturated with water, as well as any other type of air present in an environment in which a gas (e.g. air) compressor can be used. It is intended that cooling gases which are not air are encompassed by this disclosure. For non-limiting example, a cooling gas can be nitrogen, can comprise a gas mixture, can comprise nitrogen, can comprise oxygen (in a safe concentration), can comprise carbon dioxide, can comprise one inert gas or a plurality of inert gases, or comprise a mixture of gases.

In an embodiment, cooling air can be exhausted from compressor assembly 20 through a plurality of exhaust ports 31. The total cross-sectional open area of the exhaust ports 31 (the sum of the cross-sectional areas of the individual exhaust ports 31) can be a value in a range of from 3.0 in^2 to 100 in^2. In an embodiment, the total cross-sectional open area of the exhaust ports can be a value in a range of from 3.0 in^2 to 77.62 in^2. In an embodiment, the total cross-sectional open area of the exhaust ports can be a value in a range of from 4.0 in^2 to 38.81 in^2. In an embodiment, the total cross-sectional open area of the exhaust ports can be a value in a range of from 4.91 in^2 to 25.87 in^2. In an embodiment, the total cross-sectional open area of the exhaust ports can be 7.238 in^2.

Numeric values and ranges herein, unless otherwise stated, also are intended to have associated with them a tolerance and to account for variances of design and manufacturing, and/or operational and performance fluctuations. Thus, a number disclosed herein is intended to disclose values "about" that number. For example, a value X is also intended to be understood as "about X" Likewise, a range of Y-Z, is also intended to be understood as within a range of from "about Y-about Z". Unless otherwise stated, significant digits disclosed for a number are not intended to make the number an exact limiting value. Variance and tolerance, as well as operational or performance fluctuations, are an expected aspect of mechanical design and the numbers disclosed herein are intended to be construed to allow for such factors (in non-limiting e.g., ±10 percent of a given value). This disclosure is to be broadly construed. Likewise, the claims are to be broadly construed in their recitations of numbers and ranges.

The compressed gas tank 150 can operate at a value of pressure in a range of at least from ambient pressure, e.g. 14.7 psig to 3000 psig ("psig" is the unit lbf/in^2 gauge), or greater. In an embodiment, compressed gas tank 150 can operate at 200 psig. In an embodiment, compressed gas tank 150 can operate at 150 psig.

In an embodiment, the compressor has a pressure regulated on/off switch which can stop the pump when a set pressure is obtained. In an embodiment, the pump is activated when the pressure of the compressed gas tank 150 falls to 70 percent of the set operating pressure, e.g. to activate at 140 psig with an operating set pressure of 200 psig (140 psig=0.70*200 psig).

In an embodiment, the pump is activated when the pressure of the compressed gas tank 150 falls to 80 percent of the set operating pressure, e.g. to activate at 160 psig with an operating set pressure of 200 psig (160 psig=0.80*200 psig). Activation of the pump can occur at a value of pressure in a wide range of set operating pressure, e.g. 25 percent to 99.5 percent of set operating pressure. Set operating pressure can also be a value in a wide range of pressure, e.g. a value in a range of from 25 psig to 3000 psig. An embodiment of set pressure can be 50 psig, 75 psig, 100 psig, 150 psig, 200 psig, 250 psig, 300 psig, 500 psig, 1000 psig, 2000 psig, 3000 psig, or greater than or less than, or a value in between these example numbers.

The compressor assembly 20 disclosed herein in its various embodiments achieves a reduction in the noise created by the vibration of the air tank while the air compressor is running, in its compressing state (pumping state) e.g. to a value in a range of from 60-75 dBA, or less, as measured by IS03744-1995. Noise values discussed herein are compliant with IS03744-1995. IS03744-1995 is the standard for noise data and results for noise data, or sound data, provided in this application. Herein "noise" and "sound" are used synonymously.

The pump assembly 25 can be mounted to an air tank and can be covered with a housing 21. A plurality of optional decorative shapes 141 can be formed on the front housing portion 161. The plurality of optional decorative shapes 141 can also be sound absorbing and/or vibration dampening shapes. The plurality of optional decorative shapes 141 can optionally be used with, or contain at least in part, a sound absorbing material.

FIG. 2 is a front view of internal components of the compressor assembly.

The compressor assembly 20 can include a pump assembly 25. In an embodiment, pump assembly 25 which can compress a gas, air or gas mixture. In an embodiment in which the pump assembly 25 compresses air, it is also referred to herein as air compressor 25, or compressor 25. In an embodiment, the pump assembly 25 can be powered by a motor 33 (e.g. FIG. 3).

FIG. 2 illustrates the compressor assembly 20 with a portion of the housing 21 removed and showing the pump assembly 25. In an embodiment, the fan-side housing 180 can have a fan cover 181 and a plurality of intake ports 182. The cooling gas, for example, air, can be fed through an air inlet space 184 which feeds air into the fan 200 (e.g. FIG. 3). In an embodiment, the fan 200 can be housed proximate to an air intake port 186 of an air ducting shroud 485.

Air ducting shroud 485 can have a shroud inlet scoop 484. As illustrated in FIG. 2, air ducting shroud 485 is shown encasing the fan 200 and the motor 33 (FIG. 3). In an embodiment, the shroud inlet scoop 484 can encase the fan 200, or at least a portion of the fan and at least a portion of motor 33. In this embodiment, an air inlet space 184 which feeds air into the fan 200 is shown. The air ducting shroud 485 can encase the fan 200 and the motor 33, or at least a portion of these components.

FIG. 2 is an intake muffler 900 which can receive feed air for compression (also herein as "feed air 990"; e.g. FIG. 8) via the intake muffler feed line 898. The feed air 990 can pass through the intake muffler 900 and be fed to the cylinder head 61 via the muffler outlet line 902. The feed air 990 can be compressed in pump cylinder 60 by piston 63. The piston can be provided with a seal which can function, such as slide, in the cylinder without liquid lubrication. The cylinder head 61 can be shaped to define an inlet chamber 81 (e.g. FIG. 9) and an outlet chamber 82 (e.g. FIG. 8) for a compressed gas, such as air (also known herein as "compressed air 999" or "compressed gas 999"; e.g. FIG. 10). In an embodiment, the pump cylinder 60 can be used as at least a portion of an inlet chamber 81. A gasket can form an air tight seal between the cylinder head 61 and the valve plate assembly 62 to prevent a leakage of a high pressure gas, such as compressed air 999, from the outlet chamber 82. Compressed air 999 can exit the cylinder head 61 via a compressed gas outlet port 782 and can pass through a compressed gas outlet line 145 to enter the compressed gas tank 150.

Figure 9:
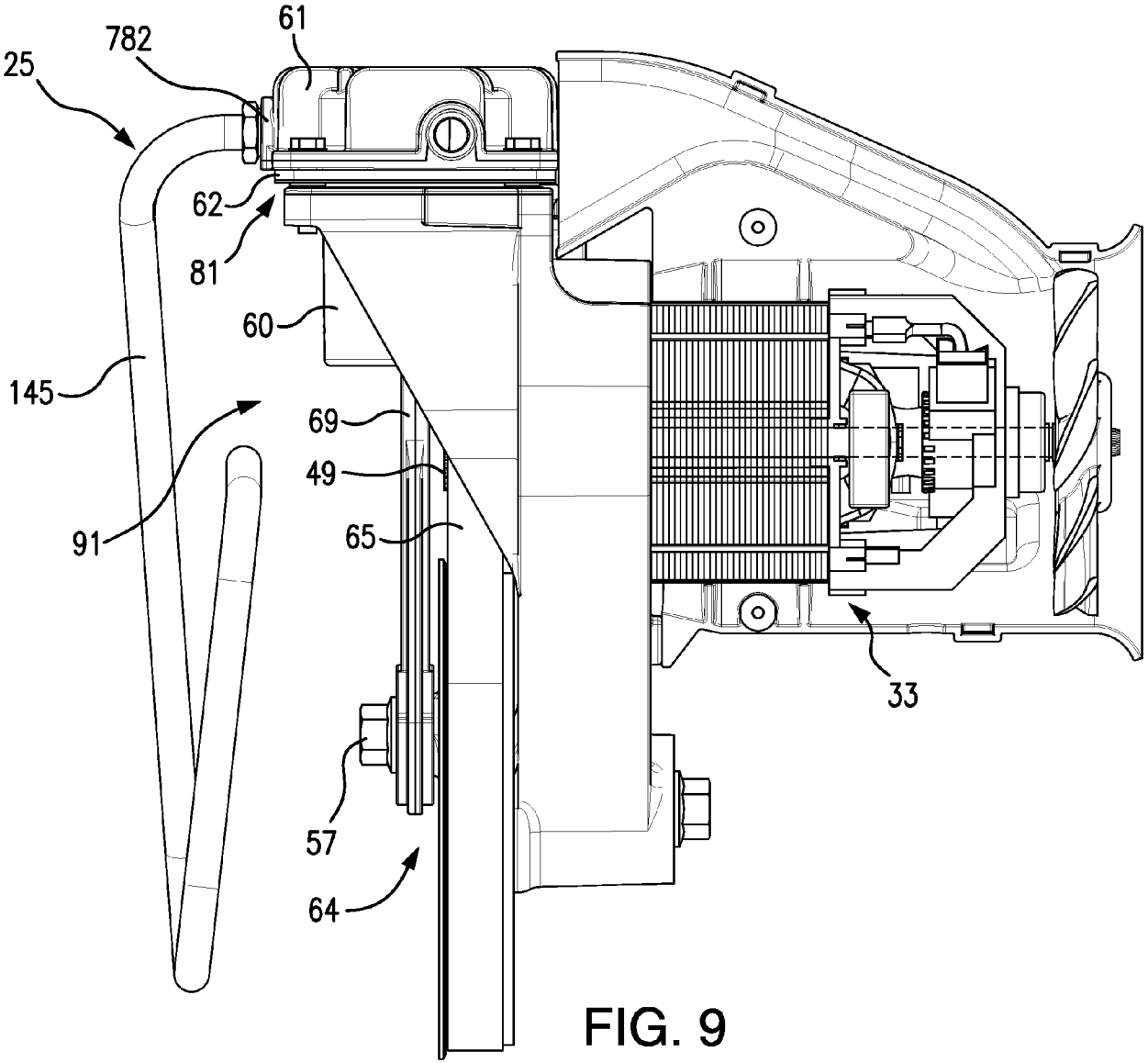
FIG. 9 is a top view of components of the pump assembly.

As shown in FIG. 2, the pump assembly 25 can have a pump cylinder 60, a cylinder head 61, a valve plate assembly 62 mounted between the pump cylinder 60 and the cylinder head 61, and a piston 63 which is reciprocated in the pump cylinder 60 by an eccentric drive 64 (e.g. FIG. 9). The eccentric drive 64 can include a sprocket 49 which can drive a drive belt 65 which can drive a pulley 66. A bearing 67 can be eccentrically secured to the pulley 66 by a screw, or a rod bolt 57, and a connecting rod 69. Preferably, the sprocket 49 and the pulley 66 can be spaced around their perimeters and the drive belt 65 can be a timing belt. The pulley 66 can be mounted about pulley centerline 887 and linked to a sprocket 49 by the drive belt 65 (FIG. 3) which can be configured on an axis which is represent herein as a shaft centerline 886 supported by a bracket and by a bearing 47 (FIG. 3). A bearing can allow the pulley 66 to be rotated about an axis 887 (FIG. 10) when the motor rotates the sprocket 49. As the pulley 66 rotates about the axis 887 (FIG. 10), the bearing 67 (FIG. 2) and an attached end of the connecting rod 69 are moved around a circular path.

The piston 63 can be formed as an integral part of the connecting rod 69. A compression seal can be attached to the piston 63 by a retaining ring and a screw. In an embodiment, the compression seal can be a sliding compression seal.

A cooling gas stream, such as cooling air stream 2000 (FIG. 3), can be drawn through intake ports 182 to feed fan 200. The cooling air stream 2000 can be divided into a number of different cooling air stream flows which can pass through portions of the compressor assembly and exit separately, or collectively as an exhaust air steam through the plurality of exhaust ports 31. Additionally, the cooling gas, e.g. cooling air stream 2000, can be drawn through the plurality of intake ports 182 and directed to cool the internal components of the compressor assembly 20 in a predetermined sequence to optimize the efficiency and operating life of the compressor assembly 20. The cooling air can be heated by heat transfer from compressor assembly 20 and/or the components thereof, e.g. pump assembly 25 (FIG. 3). The heated air can be exhausted through the plurality of exhaust ports 31.

In an embodiment, one fan can be used to cool both the pump and motor. A design using a single fan to provide cooling to both the pump and motor can require less air flow than a design using two or more fans, e.g. using one or more fans to cool the pump, and also using one or more fans to cool the motor. Using a single fan to provide cooling to both the pump and motor can reduce power requirements and also reduces noise production as compared to designs using a plurality of fans to cool the pump and the motor, or which use a plurality of fans to cool the pump assembly 25, or the compressor assembly 20.

In an embodiment, the fan blade 205 (e.g. FIG. 3) establishes a forced flow of cooling air through the internal housing, such as the air ducting shroud 485. The cooling air flow through the air ducting shroud can be a volumetric flow rate having a value of between 25 CFM to 400 CFM. The cooling air flow through the air ducting shroud can be a volumetric flow rate having a value of between 45 CFM to 125 CFM.

In an embodiment, the outlet pressure of cooling air from the fan can be in a range of from 1 psig to 50 psig. In an embodiment, the fan 200 can be a low flow fan with which generates an outlet pressure having a value in a range of from 1 in of water to 10 psi. In an embodiment, the fan 200 can be a low flow fan with which generates an outlet pressure having a value in a range of from 2 in of water to 5 psi.

In an embodiment, the air ducting shroud 485 can flow 100 CFM of cooling air with a pressure drop of from 0.0002 psi to 50 psi along the length of the air ducting shroud. In an embodiment, the air ducting shroud 485 can flow 75 CFM of cooling air with a pressure drop of 0.028 psi along its length as measured from the entrance to fan 200 through the exit from conduit 253 (FIG. 7).

In an embodiment, the air ducting shroud 485 can flow 75 CFM of cooling air with a pressure drop of 0.1 psi along its length as measured from the outlet of fan 200 through the exit from conduit 253. In an embodiment, the air ducting shroud 485 can flow 100 CFM of cooling air with a pressure drop of 1.5 psi along its length as measured from the outlet of fan 200 through the exit from conduit 253. In an embodiment, the air ducting shroud 485 can flow 150 CFM of cooling air with a pressure drop of 5.0 psi along its length as measured from the outlet of fan 200 through the exit from conduit 253.

In an embodiment, the air ducting shroud 485 can flow 75 CFM of cooling air with a pressure drop in a range of from 1.0 psi to 30 psi across as measured from the outlet of fan 200 across the motor 33.

Depending upon the compressed gas output, the design rating of the motor 33 and the operating voltage, in an embodiment, the motor 33 can operate at a value of rotation (motor speed) between 5,000 rpm and 20,000 rpm. In an embodiment, the motor 33 can operate at a value in a range of between 7,500 rpm and 12,000 rpm. In an embodiment, the motor 33 can operate at e.g. 11,252 rpm, or 11,000 rpm; or 10,000 rpm; or 9,000 rpm; or 7,500 rpm; or 6,000 rpm; or 5000 rpm. In an embodiment, the motor 33 can operate at 5,000 rpm. The pulley 66 and the sprocket 49 can be sized to achieve reduced pump speeds (also herein as "reciprocation rates", or "piston speed") at which the piston 63 is reciprocated. For example, if the sprocket 49 can have a diameter of 1 in and the pulley 66 can have a diameter of 4 in, then a motor 33 speed of 14,000 rpm can achieve a reciprocation rate, or a piston speed, of 3,500 strokes per minute. In an embodiment, if the sprocket 49 can have a diameter of 1.053 in and the pulley 66 can have a diameter of 5.151 in, then a motor 33 speed of 11,252 rpm can achieve a reciprocation rate, or a piston speed (pump speed), of 2,300 strokes per minute.

FIG. 3 is a front sectional view of the motor and fan assembly.

FIG. 3 illustrates the fan 200 and motor 33 covered by air ducting shroud 485. The fan 200 is shown proximate to a shroud inlet scoop 484.

The motor can have a stator 37 with an upper pole 38 around which upper stator coil 40 is wound and/or configured. The motor can have a stator 37 with a lower pole 39 around which lower stator coil 41 is wound and/or configured. A shaft 43 can be supported adjacent a first shaft end 44 by a bearing 45 and is supported adjacent to a second shaft end 46 by a bearing 47. A plurality of fan blades 205 can be secured to the fan 200 which can be secured to the first shaft end 44. When power is applied to the motor 33, the shaft 43 rotates at a high speed to in turn drive the sprocket 49 (FIG. 2), the drive belt 65 (FIG. 4), the pulley 66 (FIG. 4) and the fan blade 200. In an embodiment, the motor can be a non-synchronous universal motor. In an embodiment, the motor can be a synchronous motor used.

The compressor assembly 20 can be designed to accommodate a variety of types of motor 33. The motors 33 can come from different manufacturers and can have horsepower ratings of a value in a wide range from small to very high. In an embodiment, a motor 33 can be purchased from the existing market of commercial motors. For example, although the housing 21 is compact, In an embodiment, it can accommodate a universal motor, or other motor type, rated, for example, at ½ horsepower, at ¾ horsepower or 1 horsepower by scaling and/or designing the air ducting shroud 485 to accommodate motors in a range from small to very large.

FIG. 3 and FIG. 4 illustrate the compression system for the compressor which is also referred to herein as the pump assembly 25. The pump assembly 25 can have a pump 59, a pulley 66, drive belt 65 and driving mechanism driven by motor 33. The connecting rod 69 can connect to a piston 63 (e.g. FIG. 10) which can move inside of the pump cylinder 60.

In one embodiment, the pump 59 such as "gas pump" or "air pump" can have a piston 63, a pump cylinder 60, in which a piston 63 reciprocates and a cylinder rod 69 (FIG. 2) which can optionally be oil-less and which can be driven to compress a gas, e.g. air. The pump 59 can be driven by a high speed universal motor, e.g. motor 33 (FIG. 3), or other type of motor.

FIG. 4 is a pump-side view of components of the pump assembly 25. The "pump assembly 25" can have the components which are attached to the motor and/or which serve to compress a gas; which in non-limiting example can comprise the fan, the motor 33, the pump cylinder 60 and piston 63 (and its driving parts), the valve plate assembly 62, the cylinder head 61 and the outlet of the cylinder head 782. Herein, the feed air system 905 system (FIG. 7) is referred to separately from the pump assembly 25.

FIG. 4 illustrates that pulley 66 is driven by the motor 33 using drive belt 65.

FIG. 4 (also see FIG. 10) illustrates an offset 880 which has a value of distance which represents one half (½) of the stroke distance. The offset 880 can have a value between 0.25 in and 6 in, or larger. In an embodiment, the offset 880 can have a value between 0.75 in and 3 in. In an embodiment, the offset 880 can have a value between 1.0 in and 2 in, e.g. 1.25 in. In an embodiment, the offset 880 can have a value of about 0.796 in. In an embodiment, the offset 880 can have a value of about 0.5 in. In an embodiment, the offset 880 can have a value of about 1.5 in.

A stroke having a value in a range of from 0.50 in and 12 in, or larger can be used. A stroke having a value in a range of from 1.5 in and 6 in can be used. A stroke having a value in a range of from 2 in and 4 in can be used. A stroke of 2.5 in can be used. In an embodiment, the stroke can be calculated to equal two (2) times the offset, for example, an offset 880 of 0.796 produces a stroke of 2(0.796)=1.592 in. In another example, an offset 880 of 2.25 produces a stroke of 2(2.25) =4.5 in. In yet another example, an offset 880 of 0.5 produces a stroke of 2(0.5)=1.0 in.

The compressed air passes through valve plate assembly 62 and into the cylinder head 61 having a plurality of cooling fins 89. The compressed gas is discharged from the cylinder head 61 through the outlet line 145 which feeds compressed gas to the compressed gas tank 150.

FIG. 4 also identifies the pump-side of upper motor path 268 which can provide cooling air to upper stator coil 40 and lower motor path 278 which can provide cooling to lower stator coil 41.

Figure 5:
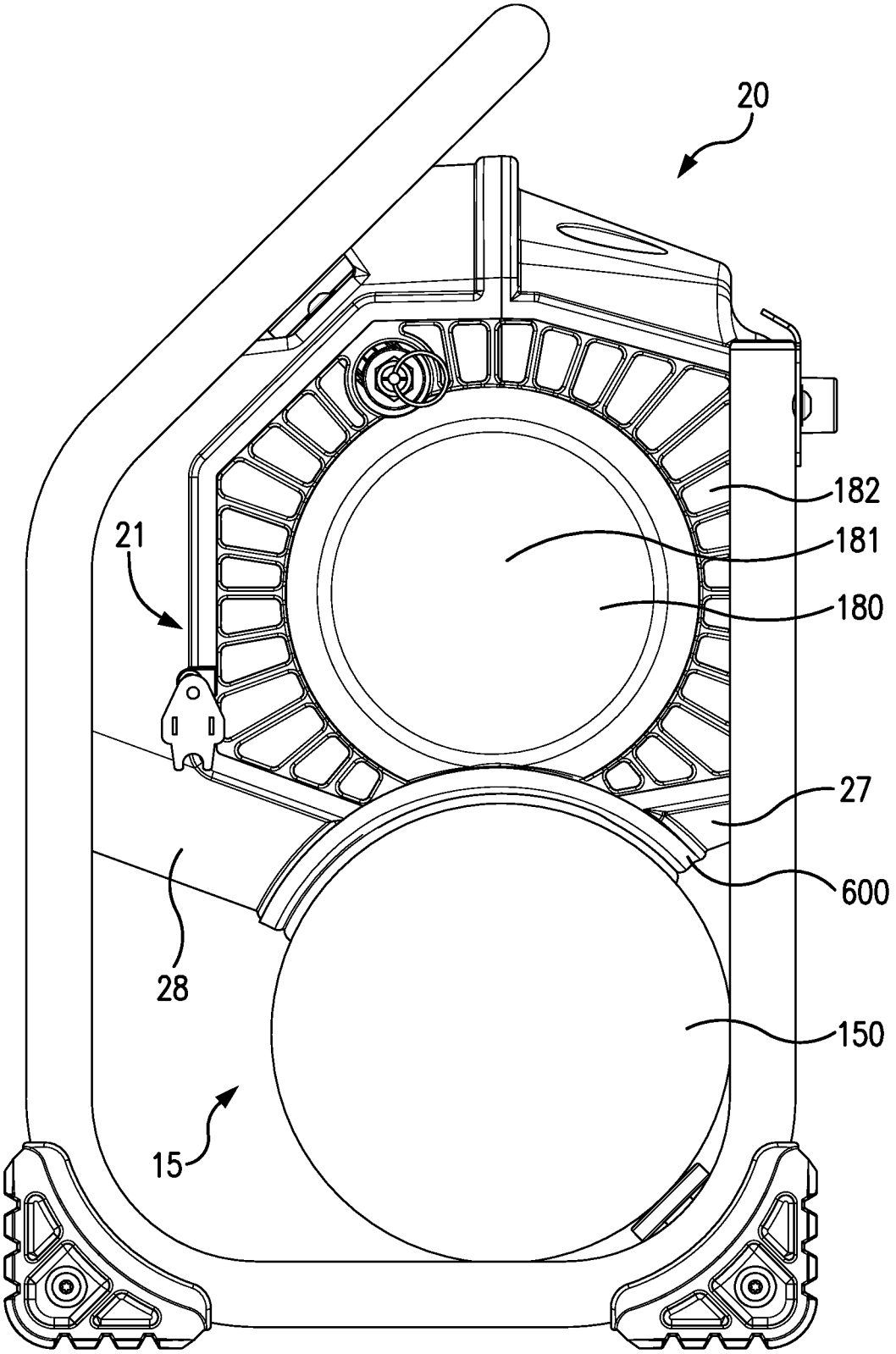
FIG. 5 is a fan-side perspective of the compressor assembly.

FIG. 5 illustrates tank seal 600 providing a seal between the housing 21 and compressed gas tank 150 viewed from fan-side 14. FIG. 5 is a fan-side perspective of the compressor assembly 20. FIG. 5 illustrates a fan-side housing 180 having a fan cover 181 with intake ports 182. FIG. 5 also shows a fan-side view of the compressed gas tank 150. Tank seal 600 is illustrated sealing the housing 21 to the compressed gas tank 150. Tank seal 600 can be a one piece member or can have a plurality of segments which form tank seal 600.

Figure 6:
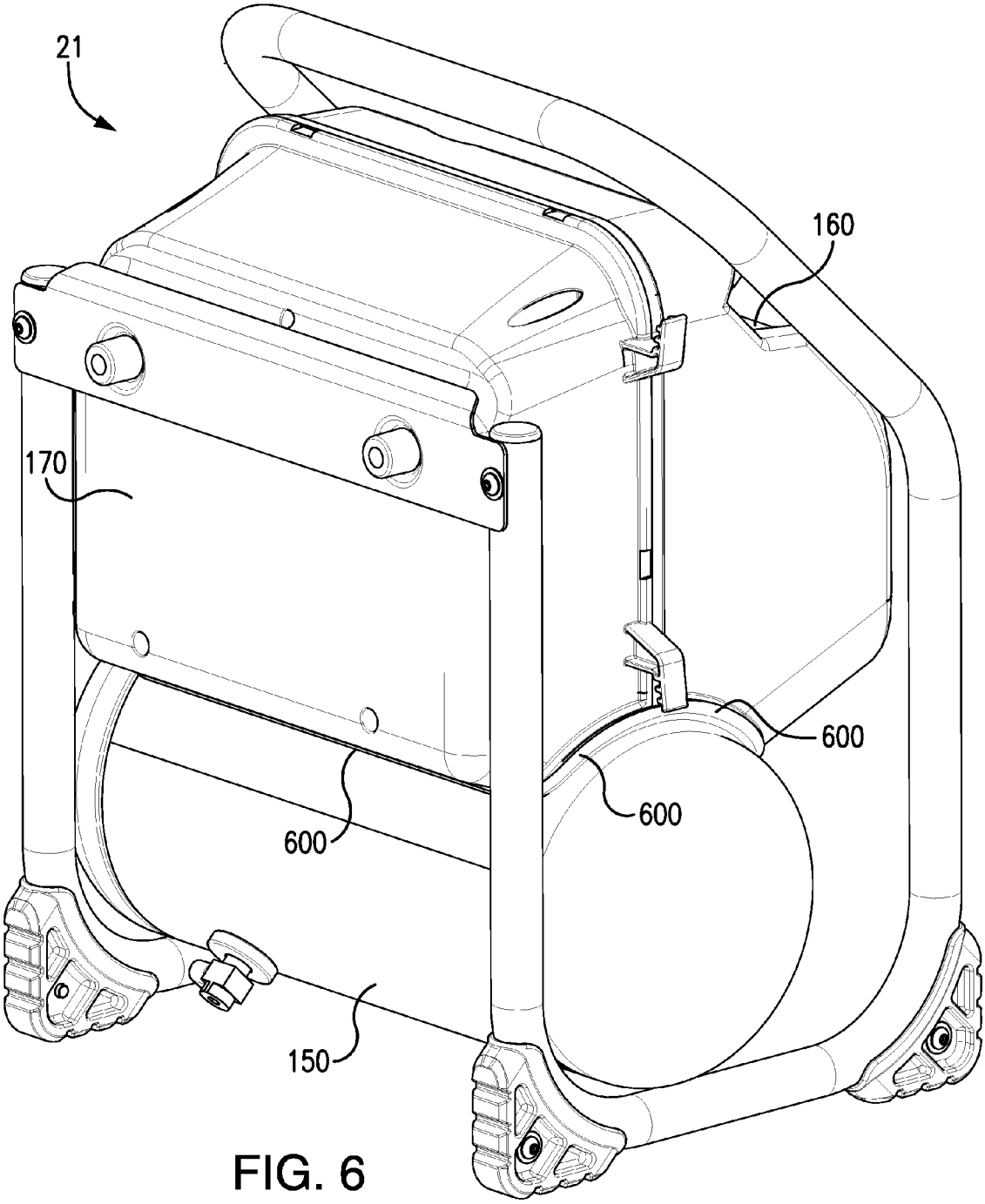
FIG. 6 is a rear perspective of the compressor assembly.

FIG. 6 is a rear-side perspective of the compressor assembly 20. FIG. 6 illustrates a tank seal 600 sealing the housing 21 to the compressed gas tank 150.

FIG. 7 is a rear view of internal components of the compressor assembly. In this sectional view, in which the rear housing 170 is not shown, the fan-side housing 180 has a fan cover 181 and intake ports 182. The fan-side housing 180 is configured to feed air to air ducting shroud 485. Air ducting shroud 485 has shroud inlet scoop 484 and conduit 253 which can feed a cooling gas, such as air, to the cylinder head 61 and pump cylinder 60.

Figure 8:
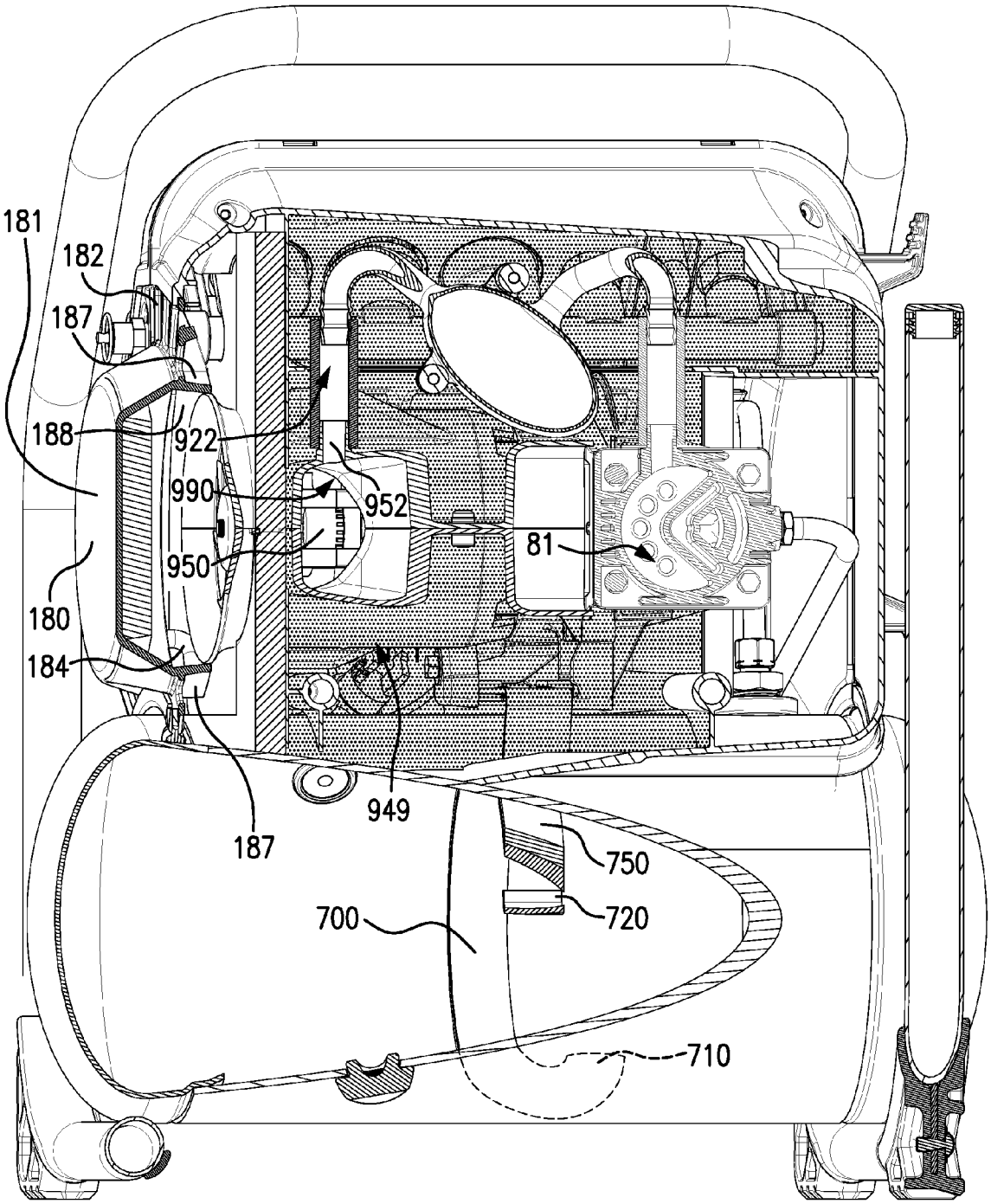
FIG. 8 is a rear sectional view of the compressor assembly.

FIG. 7 also provides a view of the feed air system 905. The feed air system 905 can feed a feed air 990 through a feed air port 952 for compression in the pump cylinder 60 of pump assembly 25. The feed air port 952 can optionally receive a clean air feed from an inertia filter 949 (FIG. 8). The clean air feed can pass through the feed air port 952 to flow through an air intake hose 953 and an intake muffler feed line 898 to the intake muffler 900. The clean air can flow from the intake muffler 900 through muffler outlet line 902 and cylinder head hose 903 to feed pump cylinder head 61. Noise can be generated by the compressor pump, such as when the piston forces air in and out of the valves of valve plate assembly 62. The intake side of the pump can provide a path for the noise to escape from the compressor which intake muffler 900 can serve to muffle.

The filter distance 1952 between an inlet centerline 1950 of the feed air port 952 and a scoop inlet 1954 of shroud inlet scoop 484 can vary widely and have a value in a range of from 0.5 in to 24 in, or even greater for larger compressor assemblies. The filter distance 1952 between inlet centerline 1950 and inlet cross-section of shroud inlet scoop 484 identified as scoop inlet 1954 can be e.g. 0.5 in, or 1.0 in, or 1.5 in, or 2.0 in, or 2.5 in, or 3.0 in, or 4.0 in, or 5.0 in or 6.0 in, or greater. In an embodiment, the filter distance 1952 between inlet centerline 1950 and inlet cross-section of shroud inlet scoop 484 identified as scoop inlet 1954 can be 1.859 in. In an embodiment, the inertia filter can have multiple inlet ports which can be located at different locations of the air ducting shroud 485. In an embodiment, the inertial filter is separate from the air ducting shroud and its feed is derived from one or more inlet ports.

FIG. 7 illustrates that compressed air can exit the cylinder head 61 via the compressed gas outlet port 782 and pass through the compressed gas outlet line 145 to enter the compressed gas tank 150. FIG. 7 also shows a rear-side view of manifold 303.

FIG. 8 is a rear sectional view of the compressor assembly 20. FIG. 8 illustrates the fan cover 181 having a plurality of intake ports 182. A portion of the fan cover 181 can be extended toward the shroud inlet scoop 484, e.g. the rim 187. In this embodiment, the fan cover 181 has a rim 187 which can eliminate a visible line of sight to the air inlet space 184 from outside of the housing 21. In an embodiment, the rim 187 can cover or overlap an air space 188. FIG. 8 illustrates an inertia filter 949 having an inertia filter chamber 950 and air intake path 922.

In an embodiment, the rim 187 can extend past the air inlet space 184 and overlaps at least a portion of the shroud inlet scoop 484. In an embodiment, the rim 187 does not extend past and does not overlap a portion of the shroud inlet scoop 484 and the air inlet space 184 can have a width between the rim 187 and a portion of the shroud inlet scoop 484 having a value of distance in a range of from 0.1 in to 2 in, e.g. 0.25 in, or 0.5 in. In an embodiment, the air ducting shroud 485 and/or the shroud inlet scoop 484 can be used to block line of sight to the fan 200 and the pump assembly 25 in conjunction with or instead of the rim 187.

The inertia filter 949 can provide advantages over the use of a filter media which can become plugged with dirt and/or particles and which can require replacement to prevent degrading of compressor performance. Additionally, filter media, even when it is new, creates a pressure drop and can reduce compressor performance.

Air must make a substantial change in direction from the flow of cooling air to become compressed gas feed air to enter and pass through the feed air port 952 to enter the air intake path 922 from the inertia filter chamber 950 of the inertia filter 949. Any dust and other particles dispersed in the flow of cooling air have sufficient inertia that they tend to continue moving with the cooling air rather than change direction and enter the air intake path 922.

FIG. 8 also shows a section of a dampening ring 700. The dampening ring 700 can optionally have a cushion member 750, as well as optionally a first hook 710 and a second hook 720.

FIG. 9 is a top view of the components of the pump assembly 25.

Pump assembly 25 can have a motor 33 which can drive the shaft 43 which causes a sprocket 49 to drive a drive belt 65 to rotate a pulley 66. The pulley 66 can be connected to and can drive the connecting rod 69 which has a piston 63 (FIG. 2) at an end. The piston 63 can compress a gas, in the pump cylinder 60 pumping the compressed gas through the valve plate assembly 62 into the cylinder head 61 and then out through a compressed gas outlet port 782 through an outlet line 145 and into the compressed gas tank 150.

FIG. 9 also shows a pump 91. Herein, pump 91 collectively refers to a combination of parts including the cylinder head 61, the pump cylinder 60, the piston 63 and the connecting rod having the piston 63, as well as the components of these parts.

Figure 10:
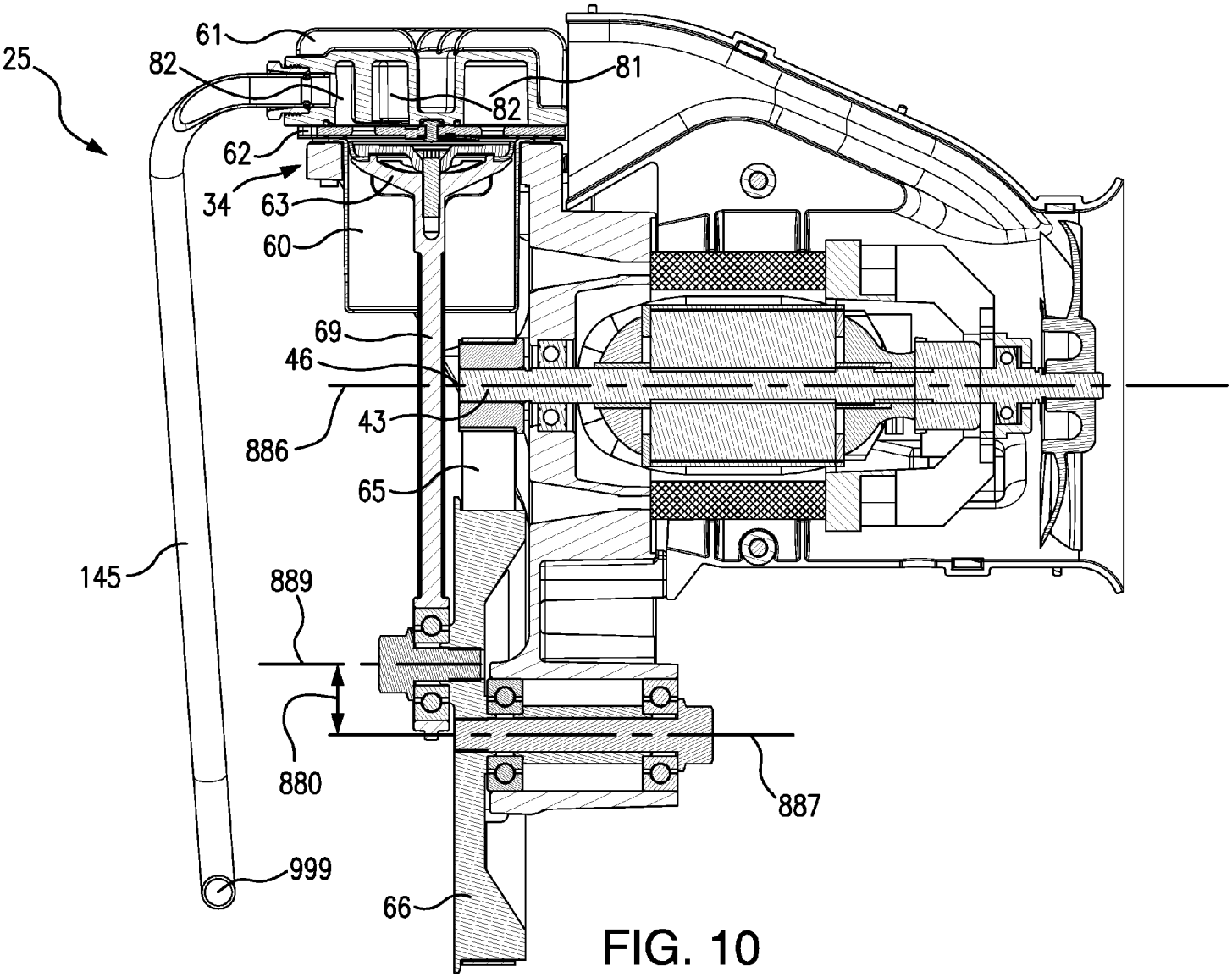
FIG. 10 is a top sectional view of the pump assembly.

FIG. 10 is a top sectional view of the pump assembly 25. FIG. 10 also shows a shaft centerline 886, as well as pulley centerline 887 and a rod bolt centerline 889 of a rod bolt 57. FIG. 10 illustrates an offset 880 which can be a dimension having a value in the range of 0.5 in to 12 in, or greater. In an embodiment, the stroke can be 1.592 in, from an offset 880 of 0.796 in. FIG. 10 also shows air inlet chamber 81.

Figure 11:
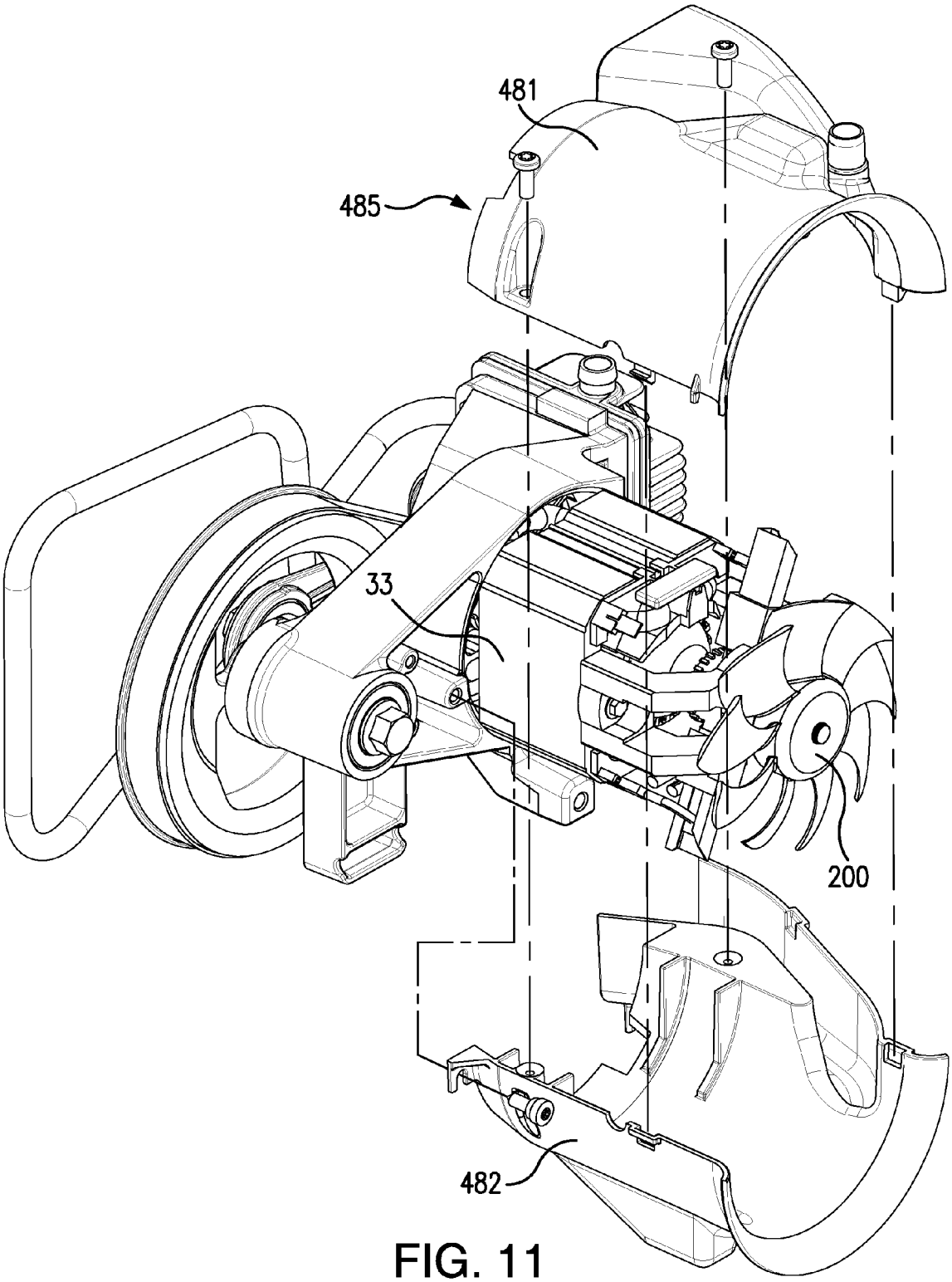
FIG. 11 is an exploded view of the air ducting shroud.

FIG. 11 is an exploded view of the air ducting shroud 485. In an embodiment, the air ducting shroud 485 can have an upper ducting shroud 481 and a lower ducting shroud 482. In the example of FIG. 11, the upper ducting shroud 481 and the lower ducting shroud 482 can be fit together to shroud the fan 200 and the motor 33 and can create air ducts for cooling pump assembly 25 and/or the compressor assembly 20. In an embodiment, the air ducting shroud 485 can also be a motor cover for motor 33. The upper air ducting shroud 481 and the lower air ducting shroud 482 can be connected by a broad variety of means which can include snaps and/or screws.

Figure 12:
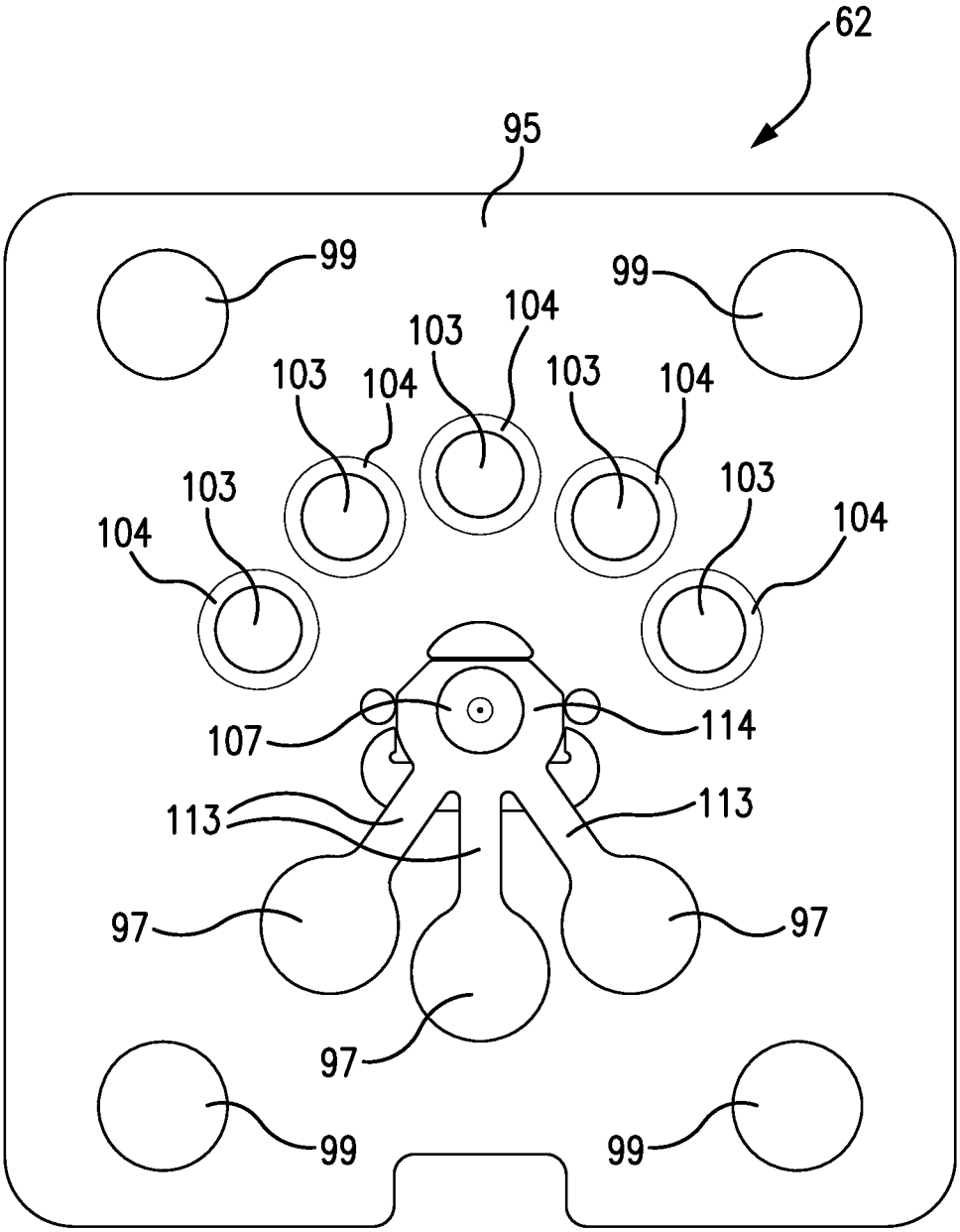
FIG. 12 is a rear view of a valve plate assembly.

FIG. 12 is a rear-side view of a valve plate assembly. A valve plate assembly 62 is shown in detail in FIGS. 12, 13 and 14.

The valve plate assembly 62 of the pump assembly 25 can include air intake and air exhaust valves. The valves can be of a reed, flapper, one-way or other type. A restrictor can be attached to the valve plate adjacent the intake valve. Deflection of the exhaust valve can be restricted by the shape of the cylinder head which can minimize valve impact vibrations and corresponding valve stress.

Figure 13:
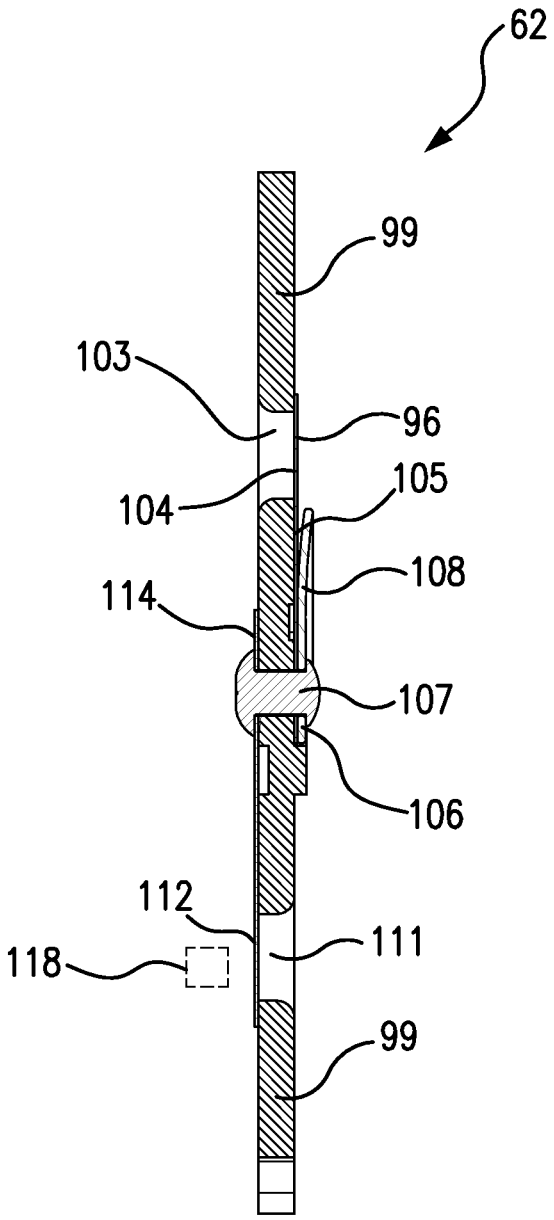
FIG. 13 is a cross-sectional view of the valve plate assembly.
Figure 14:
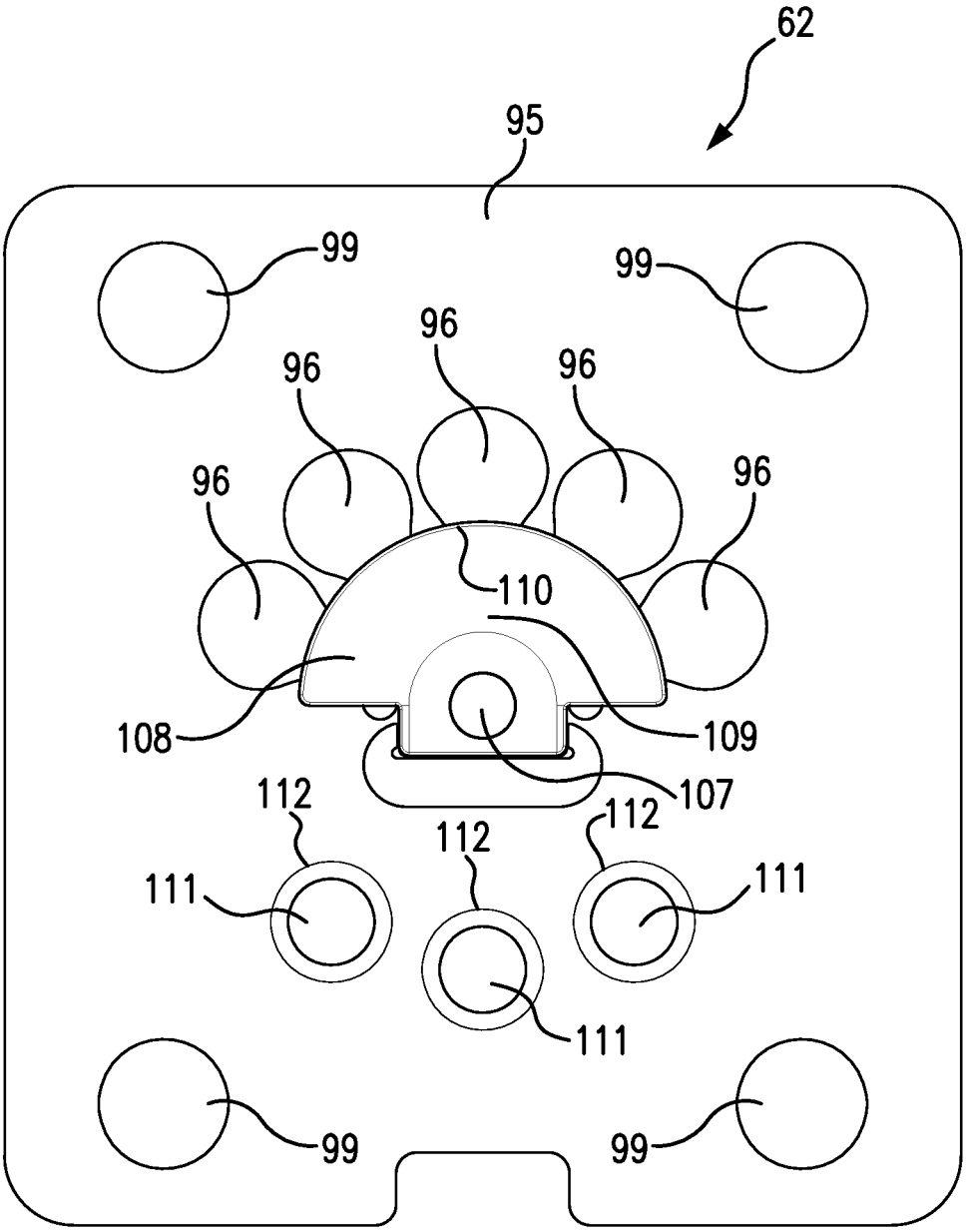
FIG. 14 is a front view of the valve plate assembly.

The valve plate assembly 62 has a plurality of intake ports 103 (five shown) which can be closed by the intake valves 96 (FIG. 14) which can extend from fingers 105 (FIG. 13). In an embodiment, the intake valves 96 can be of the reed or "flapper" type and are formed, for example, from a thin sheet of resilient stainless steel. Radial fingers 113 (FIG. 12) can radiate from a valve finger hub 114 to connect the plurality of valve members 104 of intake valves 96 and to function as return springs. A rivet 107 secures the hub 106 (e.g. FIG. 13) to the center of the valve plate 95. An intake valve restrictor 108 can be clamped between the rivet 107 and the hub 106. The surface 109 terminates at an edge 110 (FIGS. 13 and 14). When air is drawn into the pump cylinder 60 during an intake stroke of the piston 63, the radial fingers 113 can bend and the plurality of valve members 104 separate from the valve plate assembly 62 to allow air to flow through the intake ports 103.

FIG. 13 is a cross-sectional view of the valve plate assembly and FIG. 14 is a front-side view of the valve plate assembly. The valve plate assembly 62 includes a valve plate 95 which can be generally flat and which can mount a plurality of intake valves 96 (FIG. 14) and a plurality of outlet valves 97 (FIG. 12). In an embodiment, the valve plate assembly 62 (FIGS. 10 and 12) can be clamped to a bracket by screws which can pass through the cylinder head 61 (e.g. FIG. 2), the gasket and a plurality of through holes 99 in the valve plate assembly 62 and engage a bracket. A valve member 112 of the outlet valve 97 can cover an exhaust port 111. A cylinder flange and a gas tight seal can be used in closing the cylinder head assembly. In an embodiment, a flange and seal can be on a cylinder side (herein front-side) of a valve plate assembly 62 and a gasket can be between the valve plate assembly 62 and the cylinder head 61.

FIG. 14 illustrates the front side of the valve plate assembly 62 which can have a plurality of exhaust ports 111 (three shown) which are normally closed by the outlet valves 97. A plurality of a separate circular valve member 112 can be connected through radial fingers 113 (FIG. 12) which can be made of a resilient material to a valve finger hub 114. The valve finger hub 114 can be secured to the rear side of the valve plate assembly 62 by the rivet 107. Optionally, the cylinder head 61 can have a head rib 118 (FIG. 13) which can project over and can be spaced a distance from the valve members 112 to restrict movement of the exhaust valve members 112 and to lessen and control valve impact vibrations and corresponding valve stress.

Figure 15A:
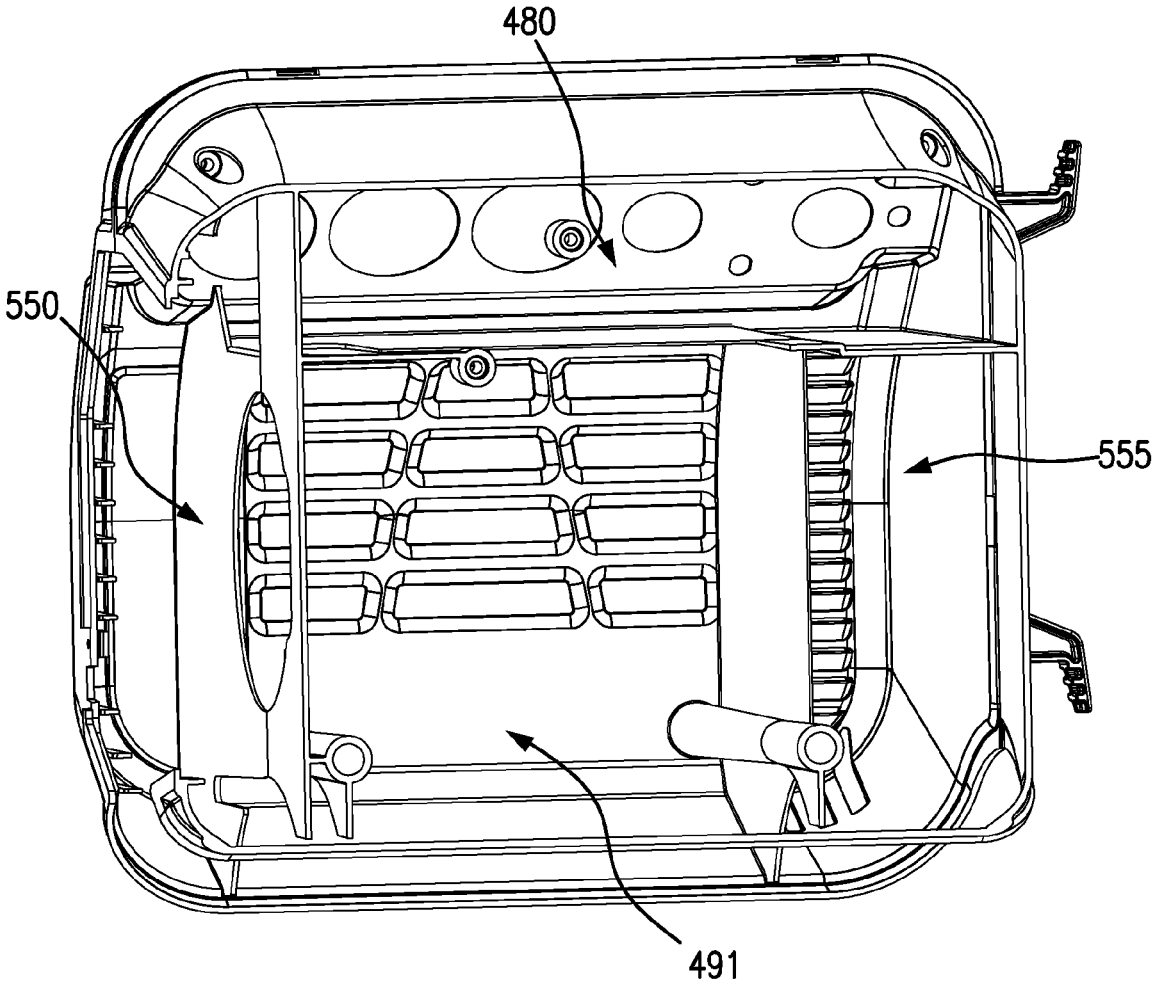
FIG. 15A is a perspective view of sound control chambers of the compressor assembly.

FIG. 15A is a perspective view of a plurality of sound control chambers of an embodiment of the compressor assembly 20. FIG. 15A illustrates an embodiment having four (4) sound control chambers. The number of sound control chambers can vary widely in a range of from one to a large number, e.g. 25, or greater. In a non-limiting example, in an embodiment, a compressor assembly 20 can have a fan sound control chamber 550 (also herein as "fan chamber 550"), a pump sound control chamber 491 (also herein as "pump chamber 491"), an exhaust sound control chamber 555 (also herein as "exhaust chamber 555"), and an upper sound control chamber 480 (also herein as "upper chamber 480").

Figure 15B:
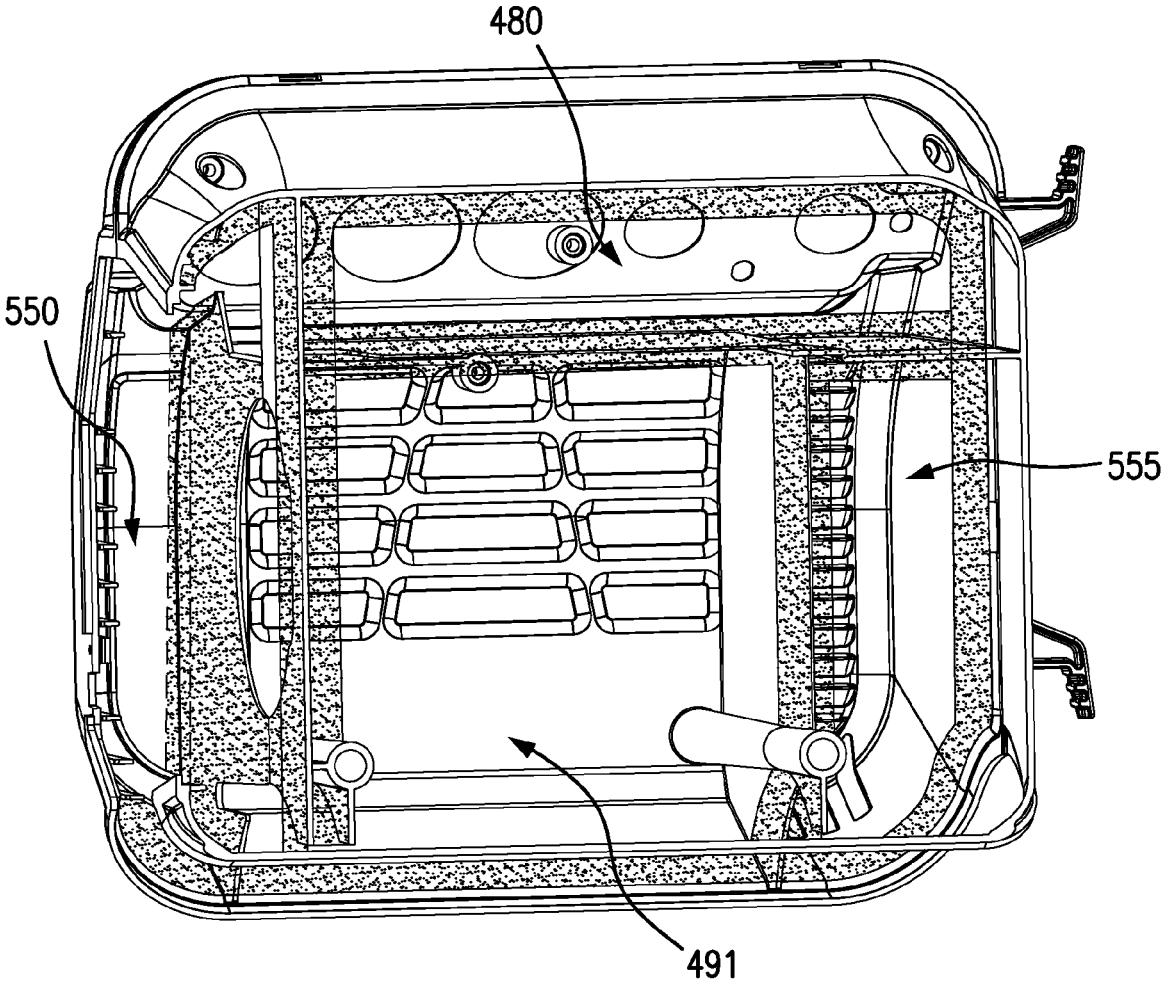
FIG. 15B is a perspective view of sound control chambers having optional sound absorbers.

FIG. 15B is a perspective view of sound control chambers having optional sound absorbers. The optional sound absorbers can be used to line the inner surface of housing 21, as well as both sides of partitions which are within the housing 21 of the compressor assembly 20.

Figure 16A:
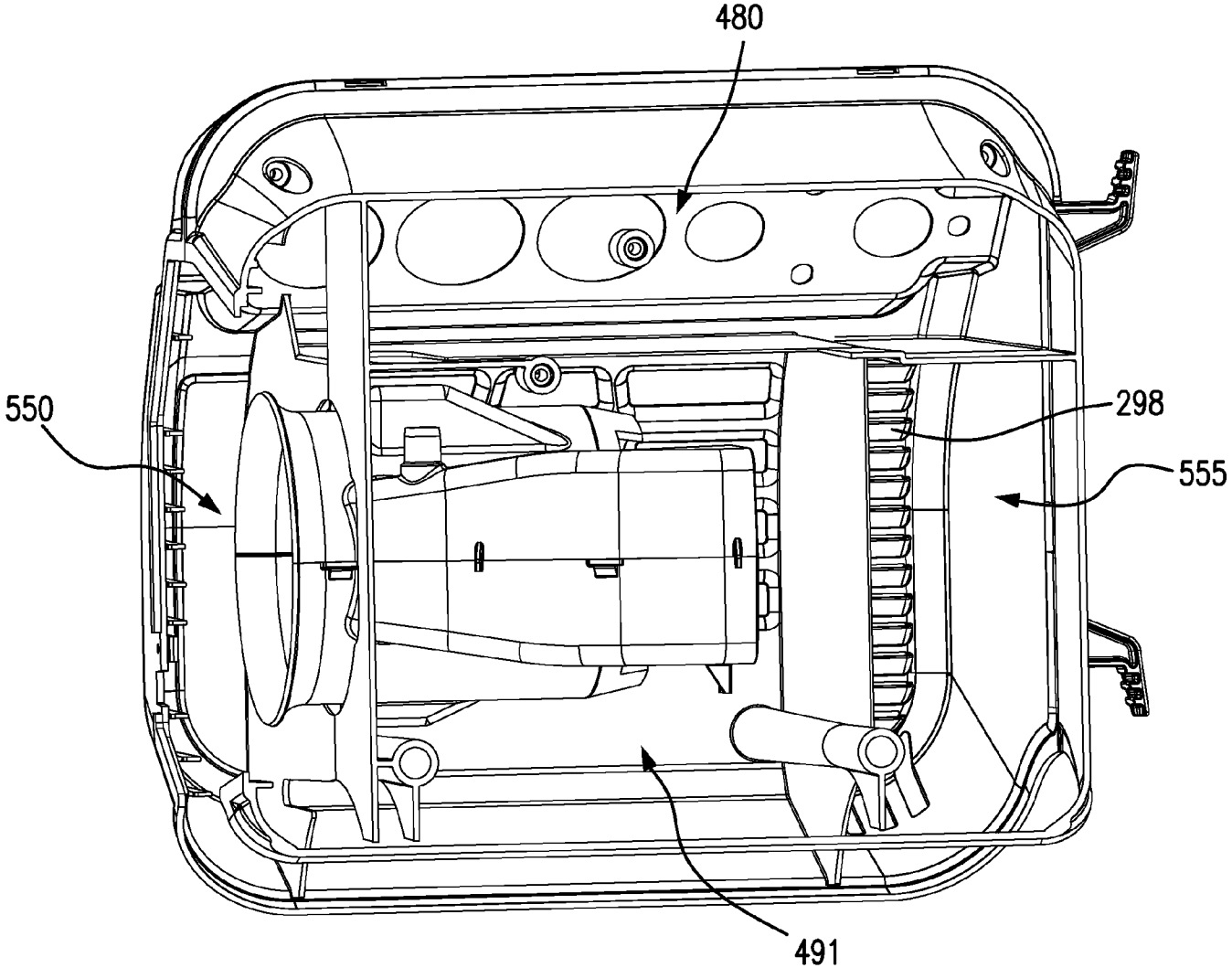
FIG. 16A is a perspective view of sound control chambers with an air ducting shroud.

FIG. 16A is a perspective view of sound control chambers with an air ducting shroud 485. FIG. 16A illustrates the placement of air ducting shroud 485 in coordination with, for example, the fan chamber 550, the pump sound control chamber 491, the exhaust sound control chamber 555, and the upper sound control chamber 480.

Figure 16B:
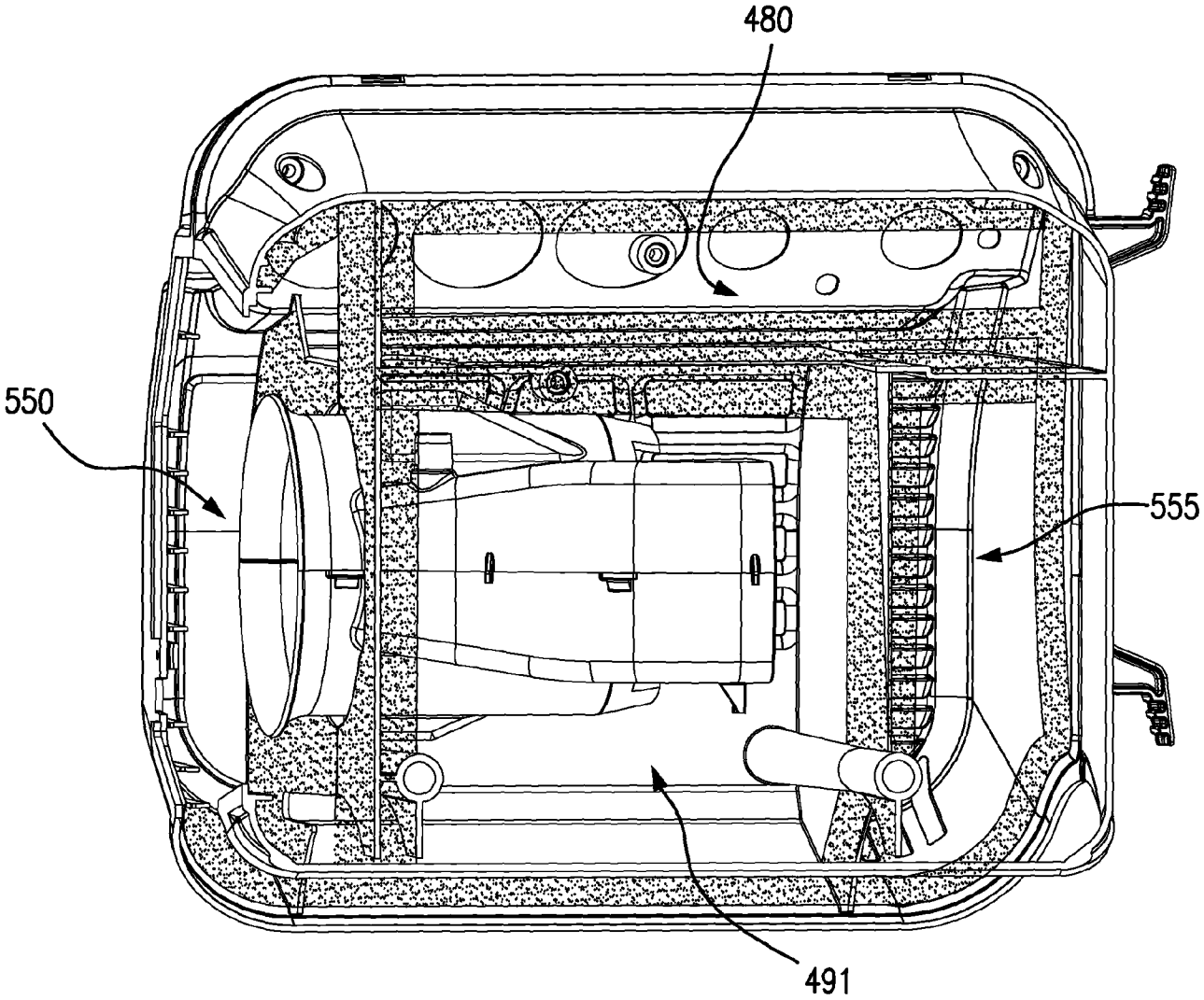
FIG. 16B is a perspective view of sound control chambers having optional sound absorbers.

FIG. 16B is a perspective view of sound control chambers having optional sound absorbers. The optional sound absorbers can be used to line the inner surface of housing 21, as well as both sides of partitions which are within the housing 21 of compressor assembly 20.

FIG. 17 is a first table of embodiments of compressor assembly range of performance characteristics. The compressor assembly 20 can have values of performance characteristics as recited in FIG. 17 which are within the ranges set forth in FIG. 17.

FIG. 18 is a second table of embodiments of ranges of performance characteristics for the compressor assembly 20. The compressor assembly 20 can have values of performance characteristics as recited in FIG. 18 which are within the ranges set forth in FIG. 18.

The compressor assembly 20 achieves efficient heat transfer. The heat transfer rate can have a value in a range of from 25 BTU/min to 1000 BTU/min. The heat transfer rate can have a value in a range of from 90 BTU/min to 500 BTU/min. In an embodiment, the compressor assembly 20 can exhibit a heat transfer rate of 200 BTU/min. The heat transfer rate can have a value in a range of from 50 BTU/min to 150 BTU/min. In an embodiment, the compressor assembly 20 can exhibit a heat transfer rate of 135 BTU/min. In an embodiment, the compressor assembly 20 exhibited a heat transfer rate of 84.1 BTU/min.

The heat transfer rate of a compressor assembly 20 can have a value in a range of 60 BTU/min to 110 BTU/min. In an embodiment of the compressor assembly 20, the heat transfer rate can have a value in a range of 66.2 BTU/min to 110 BTU/min; or 60 BTU/min to 200 BTU/min.

The compressor assembly 20 can have noise emissions reduced by e.g., slower fan and/or slower motor speeds, use of a check valve muffler, use of tank vibration dampeners, use of tank sound dampeners, use of a tank dampening ring, use of tank vibration absorbers to dampen noise to and/or from the tank walls which can reduce noise. In an embodiment, a two stage intake muffler can be used on the pump. A housing having reduced or minimized openings can reduce noise from the compressor assembly. As disclosed herein, the elimination of line of sight to the fan and other components as attempted to be viewed from outside of the compressor assembly 20 can reduce noise generated by the compressor assembly. Additionally, routing cooling air through ducts, using foam lined paths and/or routing cooling air through tortuous paths can reduce noise generation by the compressor assembly 20.

Additionally, noise can be reduced from the compressor assembly 20 and its sound level lowered by one or more of the following, employing slower motor speeds, using a check valve muffler and/or using a material to provide noise dampening of the housing 21 and its partitions and/or the compressed air tank 150 heads and shell. Other noise dampening features can include one or more of the following and be used with or apart from those listed above, using a two-stage intake muffler in the feed to a feed air port 952, elimination of line of sight to the fan and/or other noise generating parts of the compressor assembly 20, a quiet fan design and/or routing cooling air routed through a tortuous path which can optionally be lined with a sound absorbing material, such as a foam.

Optionally, fan 200 can be a fan which is separate from the shaft 43 and can be driven by a power source which is not shaft 43.

In an example, an embodiment of compressor assembly 20 achieved a decibel reduction of 7.5 dBA. In this example, noise output when compared to a pancake compressor assembly was reduced from about 78.5 dBA to about 71 dBA.

Example 1

FIG. 19 is a first table of example performance characteristics for an example embodiment. FIG. 19 contains combinations of performance characteristics exhibited by an embodiment of compressor assembly 20.

Example 2

FIG. 20 is a second table of example performance characteristics for an example embodiment. FIG. 20 contains combinations of further performance characteristics exhibited by an embodiment of compressor assembly 20.

Example 3

FIG. 21 is a table containing a third example of performance characteristics of an example compressor assembly 20. In the Example of FIG. 21, a compressor assembly 20, having an air ducting shroud 485, a dampening ring 700, an intake muffler 900, four sound control chambers, a fan cover, four foam sound absorbers and a tank seal 600 exhibited the performance values set forth in FIG. 21.

Figure 26A:
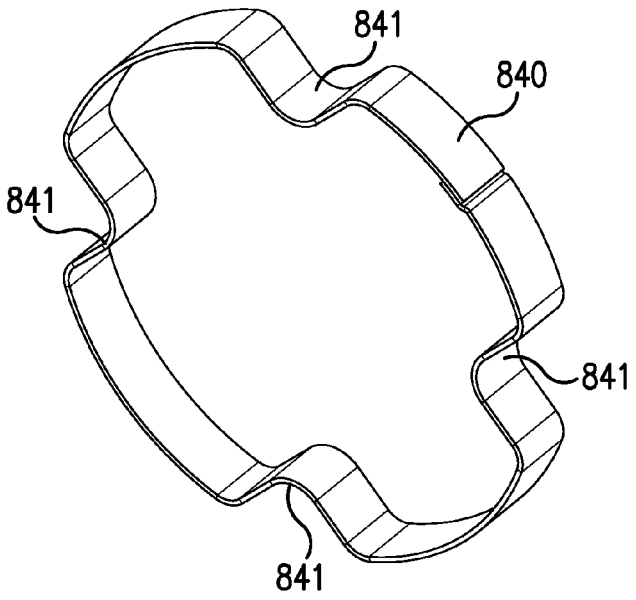
FIG. 26A is a perspective view of an expansion clover absorber.

A vibration absorber 800 for compressor tank 150 can be a member which is under compression and which applies an expansive pressure 1008 (e.g. FIGS. 10, 22, 23 and 27) to the compressed gas tank 150 and which can absorb and/or dampen vibration and/or reduce noise from the compressed gas tank 150. The vibration absorber 800 can be a plunger absorber 801 (FIG. 22), a multi-finger absorber 802 (FIG. 23), or an expansion clover absorber 840 (FIG. 26A). The vibration absorber can be in contact with tank inner surface 151 at least in part. Optionally, one or a plurality of cushion members 750 can be used between at least a portion of the expansion clover 840 and a compressor tank inner surface 151 and/or one or a plurality of stoppers 805 can be used with the plunger absorber 801 or the multi-finger absorber 802 to absorb and/or dampen vibration and/or reduce noise from the compressed gas tank 150.

The vibration absorber can provide a constant force against the walls of a compressed gas tank 150 and dampen noise which the compressed gas tank can emit during compressor operation. Other types of vibration absorbers can also optionally be used, such as a paint, a coating, a sound absorbing material and/or sound absorbing pad or blanket.

A vibration absorber formed as a resilient material can be placed between the tank wall and the plunger absorber 801, multi-finger absorber 802, or expansion clover absorber 840 to provide a constant force against the walls of the compressed gas tank 150. In an embodiment, the resilient material can have the shape of a pad which is generally longer and wider than it is thick, but can have a variety of shapes. Optionally, multiple resilient materials can be used to form a multilayer pad between a surface of the vibration absorber and a surface of the compressed gas tank 150. The plunger absorber 801 can be spring loaded and can have a plurality of fingers, for example e.g. 1, or 3, or 6, or more fingers (e.g. 30 fingers).

Figure 22:
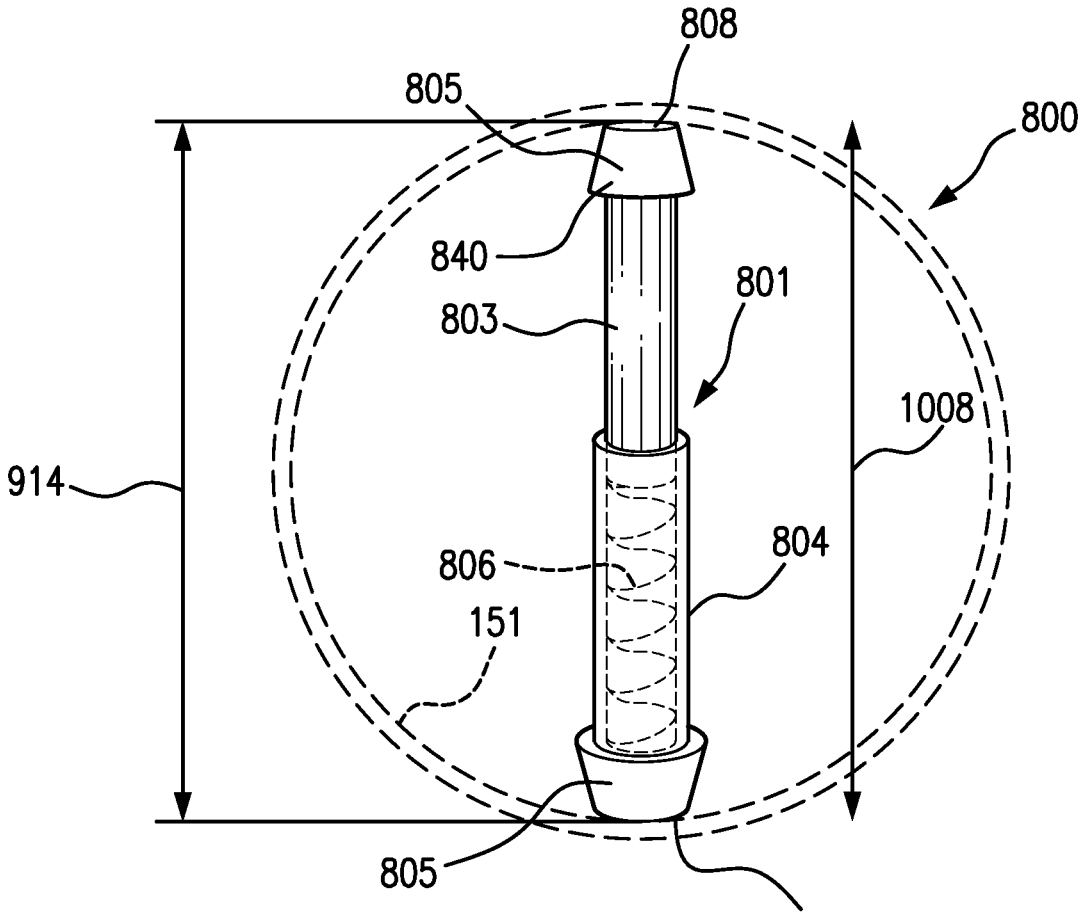
FIG. 22 is a plunger absorber.

As illustrated in FIG. 22, the plunger absorber 801 can have two ends e.g. a first plunger end 808 and a second plunger end 810. The plunger absorber 801 can be a multi-finger absorber that can be generally straight. In another embodiment shown in FIG. 23, the multi-finger absorber 802 can have three arms, each arm having an end, e.g. a first end 815, a second end 816 and a third end 817.

FIG. 22 illustrates a plunger absorber 801 which has a plunger-type form and which can be spring-loaded. In an embodiment, the plunger absorber 801 can be an internally mounted vibration absorber that can exert a constant pressure against the tank wall. In an embodiment, the plunger absorber 801 can be in contact with the compressor tank inner surface 151. Optionally, one or a plurality of stoppers 805 can be disposed between at least a portion of the plunger absorber 801 and the tank inner surface 151 and/or the one or a plurality of stoppers 805 can absorb and/or dampen vibration and/or reduce noise from the compressed gas tank 150.

Figure 24:
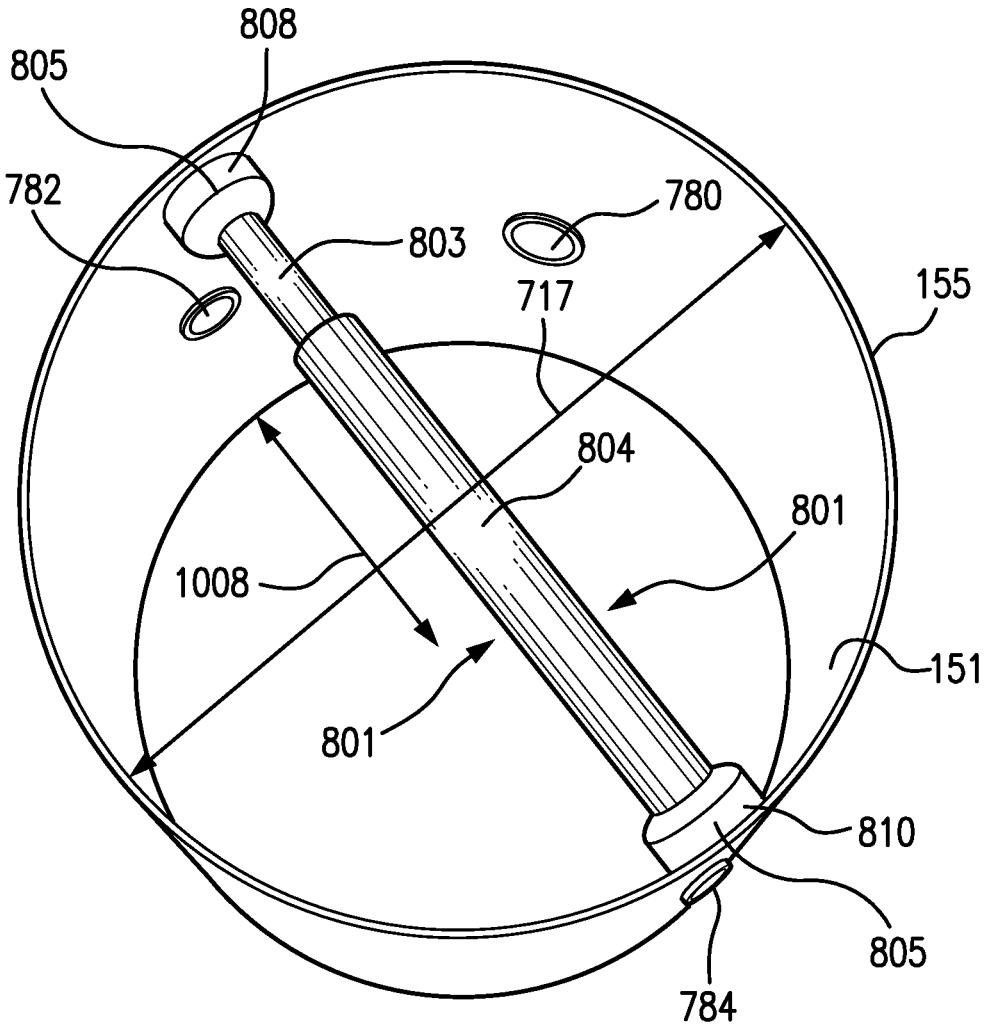
FIG. 24 is a perspective view of a shell of a compressed gas tank having a plunger absorber.

As shown in FIG. 22, in an embodiment, the plunger absorber 801 has a first compression member 803 which can have a first end 808 and a second compression member 804 which has a second end 810. In an embodiment, the first compression member 803 can be coaxial with the second compression member 804. A spring 806 can bias one or both of a first compression member 803 and the second compression member 804 against the tank inner surface 151. As shown, the stopper 805 or cushion member can be used between a respective compression member, such as the first compression member 803, or the second compression member 804 and a portion of the tank internal surface 151. In an embodiment, one of a first compression member 803 and a second compression member 804 can be inserted coaxially, at least in part into the other member. For example, at least a part of the first compression member 803 can be inserted coaxially into the second compression member 804. Alternatively, at least a part of the second compression member 803 can be inserted coaxially into the first compression member 803. FIG. 24 illustrates the plunger absorber 801 installed within a compressed gas tank section 155 which has ID 717.

In an embodiment, a rubber material or a silicone can be used to form at least a part of the stopper 805, or a cushion material. The stopper 805 can be a full stopper over an end of the plunger absorber or can be a partial stopper over a part of an end of the plunger absorber. The stopper 805 can have a durometer with a value in a range of from 40 to 90 (Shore A scale). In an embodiment, the stopper 805 can be made of silicone having a durometer value of 70 and thickness of 0.125 in.

Figure 23:
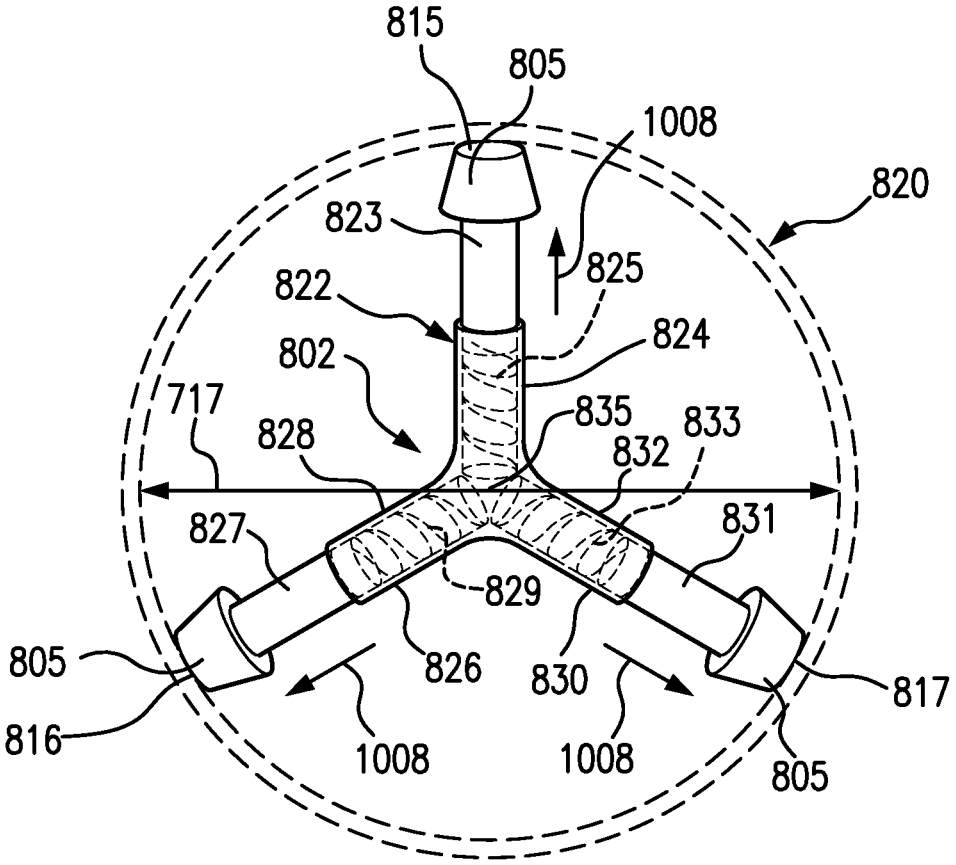
FIG. 23 is a multi-finger absorber.

FIG. 23 illustrates a multi-finger absorber 802 which can have at least three arms that project from a center portion 835.

Figure 27:
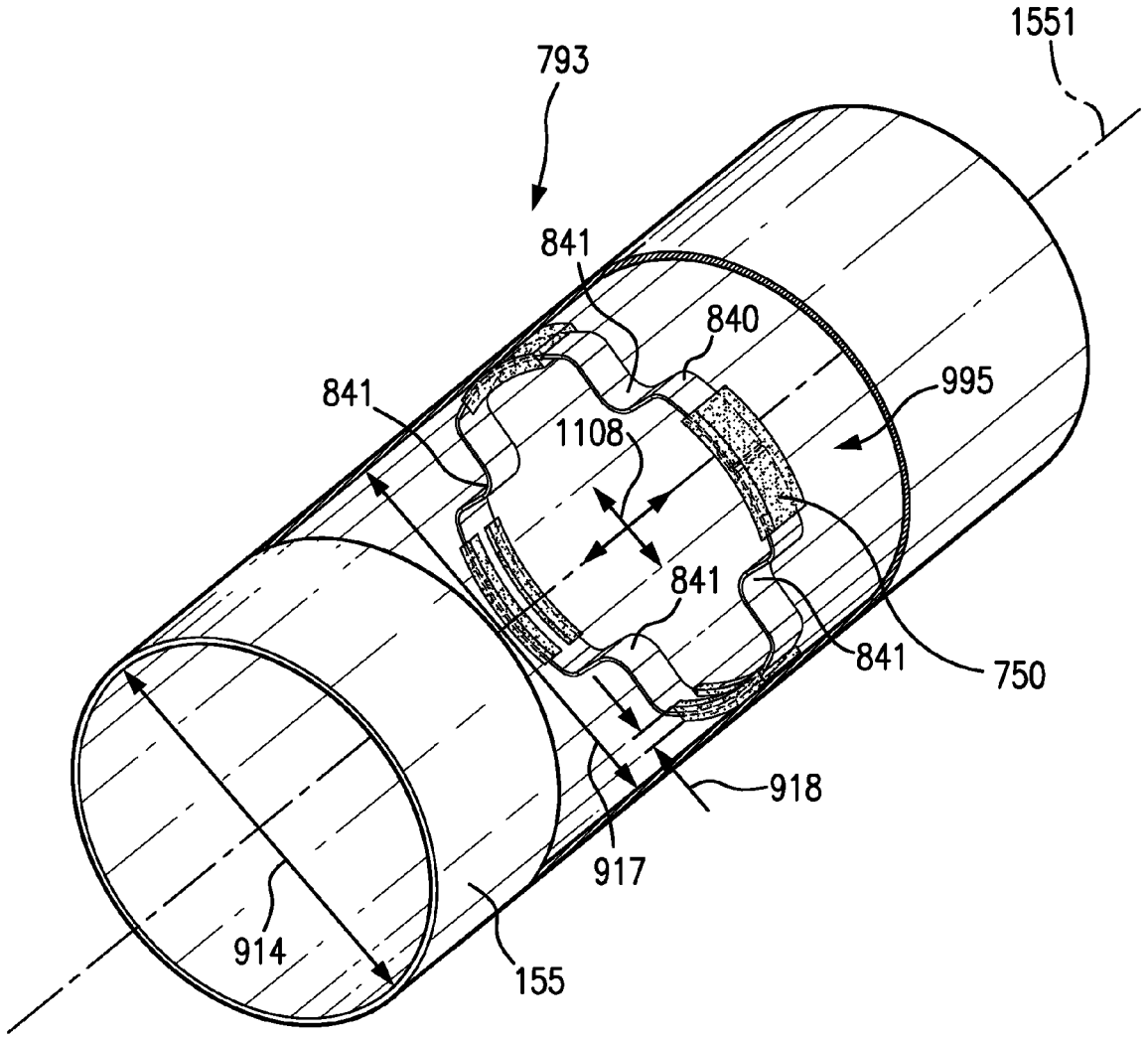
FIG. 27 is an expansion clover absorber in an installed state.

In the example embodiment of FIG. 23, a first arm 822 extends from the center portion 835 to the first end 815. First arm 822 has a first arm central member 824 and first arm radial member 823. A spring 825 can bias the first arm radial member 823 against the tank inner surface 151 and the first arm central member 824 toward the center portion 835. A second arm 826 extends from the center portion 835 to second end 816. The second arm 826 has a second arm central member 828 and second arm radial member 827. A spring 829 can bias the second arm radial member 827 against the tank inner surface 151 and the second arm central member 828 toward the center portion 835. A third arm 830 extends from the center portion 835 to the third end 817. The third arm 830 has a third arm central member 832 and a third arm radial member 831. A spring 833 can bias the third arm radial member 831 against the tank inner surface 151 and the third arm central member 832 toward the center portion 835. The center portion can be, for example, the center axis 1551 of the compressed gas tank 150 tank section 155 (FIG. 27).

In an embodiment, the plunger absorber 801 or a multi-finger absorber 802 can be compressed for insertion into position in the compressed gas tank 150, for example as illustrated in FIG. 23 by applying a force to the ends or to the individual compression members sufficient to overcome resistance and reversibly change the state of the plunger absorber 801 from an uncompressed state to a compressed state. When the vibration absorption member is being inserted into position in the compressed gas tank 150, the compressed state can be released allowing the plunger absorber 801 to expand to an installed state in which the plunger absorber can exert pressure against the tank and/or against the one or the plurality of stoppers 805.

For example, the plunger absorber 801 having a first end 808 and a second end 810 can be compressed by applying a force to the first end 808 and the second end 810, which reduces the distance between the first end 808 and the second end 810 and configures the plunger absorber 801 in a compressed state. In a non-limiting example, if the plunger absorber 801 was designed with an upper limit of compression of 60 psi, then a force of greater than 60 psi could be applied to the first end 808 and/or the second end 810 to configure the plunger absorber 801 to a compressed state. Upon insertion of the plunger absorber 801 into position in the compressed gas tank 150, the compression pressure of greater than 60 psi could be removed and the compressed state can be released allowing the plunger absorber 801 to expand to an installed state in which the plunger absorber can exert pressure against the tank or against the stoppers 805.

FIG. 23 illustrates a multi-finger absorber which has three arms. The multi-finger absorber 802 can be compressed by applying a force to the end of one or more of the arms which reduces the distance between the center portion 835 and the respective end. The multi-finger absorber 802 can be in a compressed state when one or more of its arms has been compressed to a reduced length such that the multi-finger absorber 802 can be placed inside of the compressed gas tank 150. In an embodiment, the multi-finger absorber 802 is oriented inside of the compressed gas tank 150 perpendicular to its centerline, for example center axis 1551 of the compressed gas tank section 155 (FIG. 27). When the pressure is removed, the multi-finger absorber 802 can expand to its installed state.

In an embodiment, the plunger absorber 801 can exert a pressure having a value between 30 and 300 psi against the tank or against a stopper 805. In further embodiments, the plunger absorber 801 can exert against the tank or against a stopper 805 a pressure having a value between 30 and 200 psi; or a value between 30 and 150 psi; or a value between 50 and 150 psi; or a value between 40 and 80 psi; or a value between 45 and 60 psi.

The plunger absorber 801 and the multi-finger absorber 802 can be made from a broad variety of materials. In an embodiment, the plunger absorber 801 and the multi-finger absorber 802 can be made from steel, a molded plastic, cast aluminum or zinc.

One or the plurality of stoppers 805 can be made of a broad variety of materials. In an embodiment, the stopper can be a resilient member. In an embodiment, the resilient member can be a silicone. In a non-limiting example, the silicone can be a high-temperature silicone. In an embodiment, the resilient material can have the shape of a pad, be a cushion, or a have the general shape of a sheet, blanket or cover. Optionally, multiple resilient materials can be used which can form multiple pads and/or layers between a portion of the plunger absorber 801, or the multi-finger absorber 802, or an expansion clover absorber 840 and a compressor tank inner surface 151 of the compressed gas tank 150. Other materials from which the stopper 805 can be formed have at least in part include but are not limited to rubber, cloth, felt, paint, coating, plastics, polymers, wood, or metals. This disclosure is not limited as to the construction of the stopper 805. A stopper can be of a single material or multiple materials. The stopper 805 can also be of one piece, laminated, layered or cast. The stopper material can be resilient or non resilient. In an embodiment, the stopper 805 can have both resilient and non-resilient materials. Optionally, the stopper 805 can have layers each of which is resilient, layers each of which are non-resilient.

In an embodiment, the plunger absorber 801 can be a tank dampening device that reduces the noise created by the vibration of the air tank while the air compressor is running.

FIG. 24 illustrates a compressed gas tank section 155 having a compressed gas inlet port 780, a compressed gas outlet port 782 and a tank drain port 784. In an embodiment, the compressed gas tank 150 has a plunger absorber 801 therein which can exert an expansive force 1008. A vibration absorber, such as the plunger absorber 801, the multi-finger absorber 802, or the expansion clover absorber 840 can exert an expansive pressure in a range of from 5 lbs to the maximum design pressure of the vessel into which the vibration absorber is placed. An expansive vibration absorber, such as the plunger absorber 801, the multi-finger absorber 802, or the expansion clover absorber 840, can exert an expansive pressure of, e.g. 30 psi, or 45 psi, or 50 psi, or 75 psi, or 150 psi, or 200 psi, or 3000 psi, or a value in between these pressures against the tank or against a stopper 805.

Figure 25:
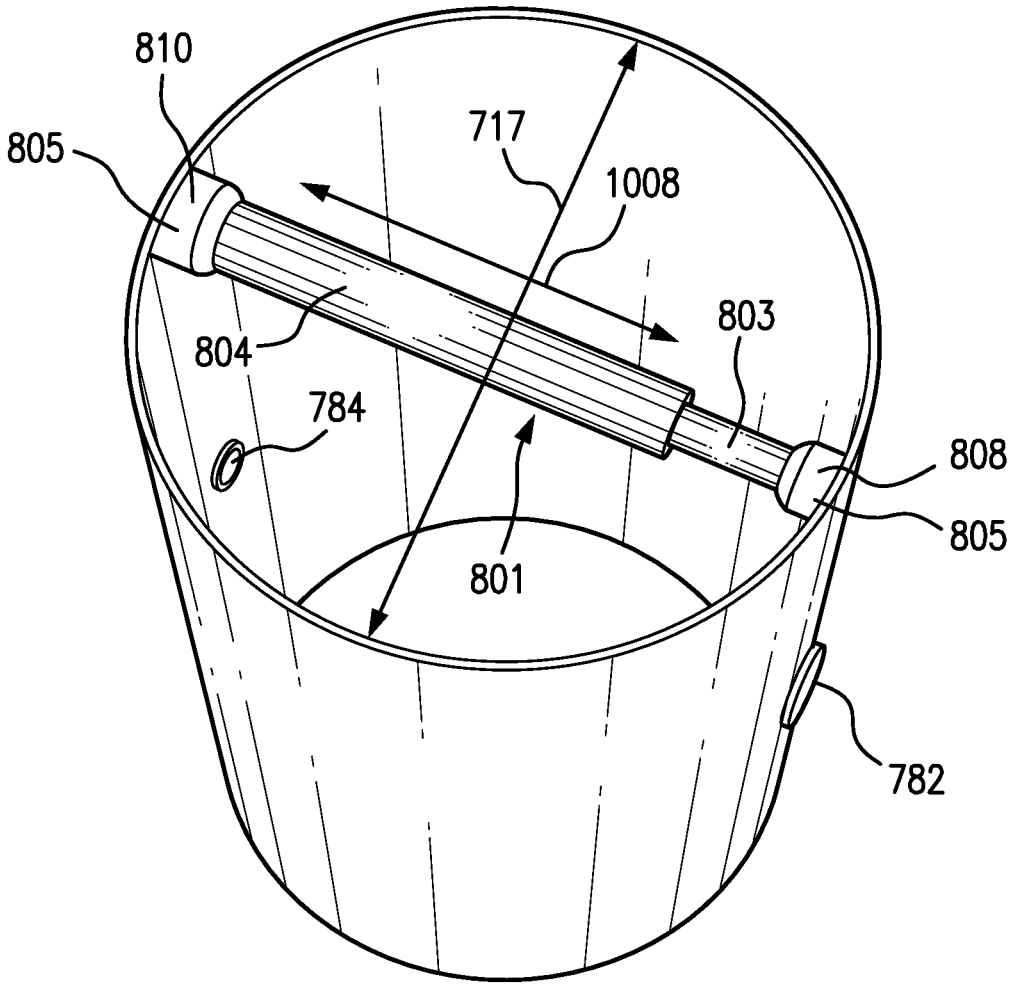
FIG. 25 is a perspective view of a section of a shell of a compressed gas tank having a plunger absorber.

FIG. 25 is a perspective view of a section of a shell of a compressed gas tank having a plunger absorber;

FIG. 26A illustrates a vibration absorber in the form of an expansion clover 840 having a plurality of compression notches 841. In an embodiment, the expansion clover 840 can also be a vibration dampening device (also herein as "tank dampening device"). In an embodiment, the expansion clover 840 can reduce the noise created by the vibration of the air tank while the air compressor is running.

The expansion clover 840 can have one or a plurality of compression notches. As shown in FIG. 26A, for example an expansion clover can have four compression notches. A compressive force can be exerted on one or more compression notches to compress the expansion clover for insertion into and removal from the compressed gas tank 150.

Figure 26C:
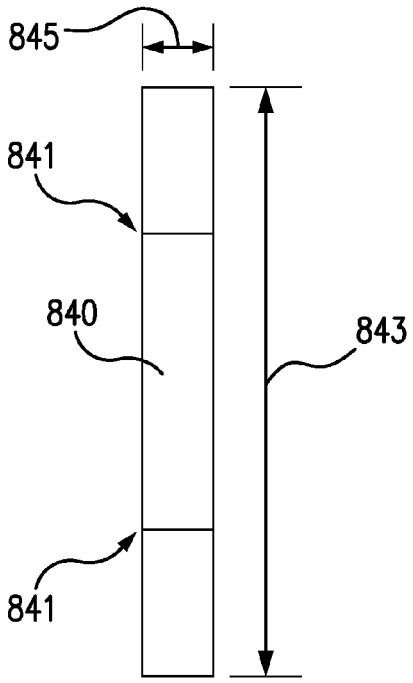
FIG. 26C is a side view of an expansion clover absorber.
Figure 26B:
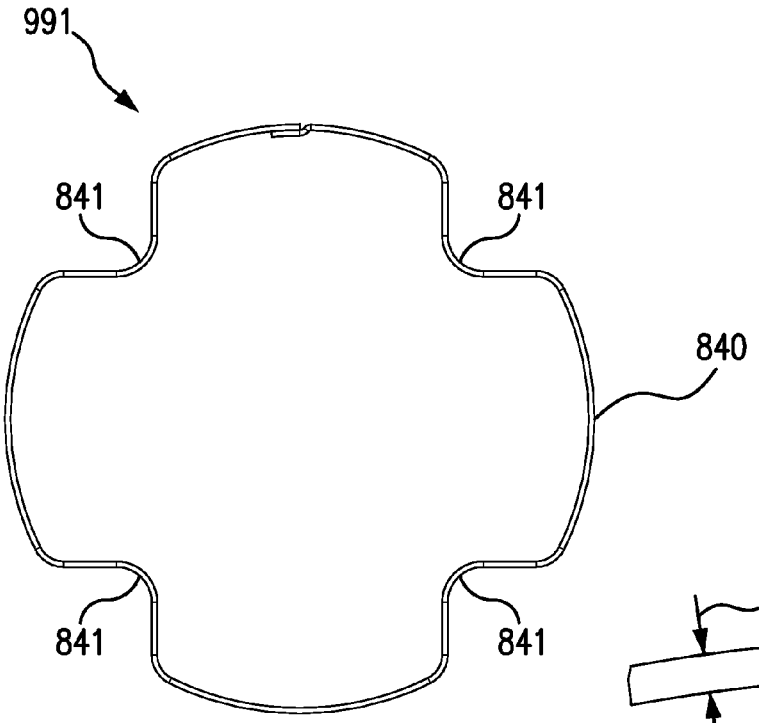
FIG. 26B is an end view of an expansion clover absorber.

FIG. 26B is an end view of the expansion clover absorber 840.

Figure 26D:
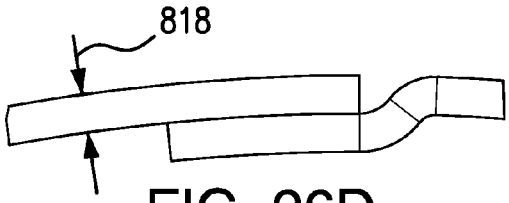
FIG. 26D is a detail view of an embodiment of a joint of an expansion clover absorber.
Figure 26E:
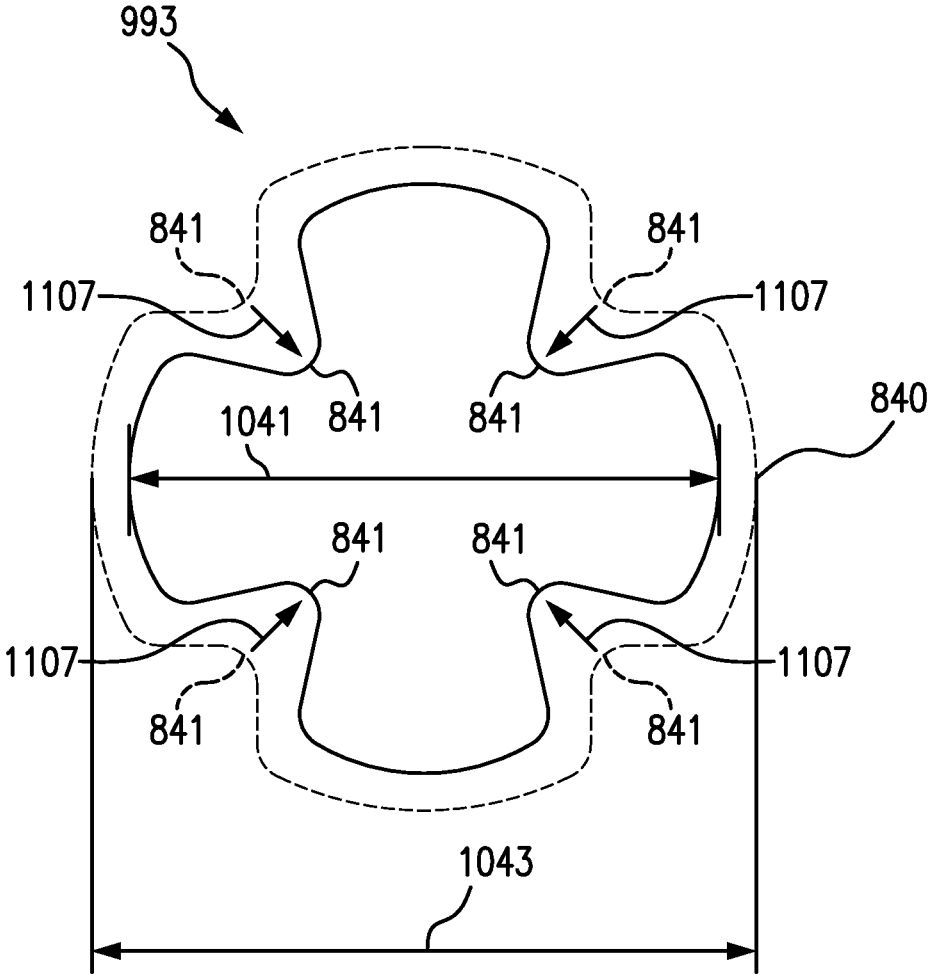
FIG. 26E is a compressed state of an expansion clover absorber.

In an embodiment, the expansion clover 840 can be compressed for insertion into position in compressed gas tank 150, by applying a force to the compression notches sufficient to overcome resistance and change the state of the expansion clover 840 from an expanded state as illustrated in FIG. 26B to a compressed state as illustrated in FIG. 26E.

FIG. 26C is a side view of an expansion clover absorber 840 having a clover height 843 and a clover width 845.

FIG. 26D is a detail view of an embodiment of a joint of an expansion clover absorber 840. In an embodiment, an expansion clover can have a clover thickness 818. As noted above, FIG. 26E illustrates a compressed state of an expansion clover absorber. As illustrated, the expansion clover 840 has a plurality of compression notches 841 that can be compressed by the application of a force to one or more of the compression notches 841 which can reduce the distance between the compression notches 841 and configures the expansion clover 840 into a compressed state 993.

In a non-limiting example, if the expansion clover 840 was designed with an upper limit of compression of 60 psi, then a force of greater than 60 psi could be applied to one or a plurality of compression notches 841 to configure the expansion clover 840 from an uncompressed state 991 to a compressed state 993. Upon insertion of the expansion clover 840 into position in compressed gas tank 150, the compression pressure of greater than 60 psi could be removed allowing the expansion clover 840 to expand from a compressed state 993 to an installed state 995 (FIG. 27) in which the expansion clover 840 can exert pressure against the compressed gas tank 150 and/or tank inner surface 151 and/or against a cushion member 750.

In an embodiment, when the expansion clover 840 exerts an outward pressure against these surfaces and/or body, the expansion clover 840 can exert such a pressure having a value between 30 psi and 300 psi; or 30 psi and 200 psi; or a value between 30 psi and 150 psi; or a value between 50 and 150 psi; or a value between 40 and 80 psi; a value between 45 and 60 psi.

FIG. 27 illustrates an expansion clover absorber 840 in an installed state.

The expansion clover 840 can have an uncompressed chord length 843. The uncompressed chord length 843 can have a value which can be significantly larger than the ID of the vessel into which the expansion clover 840 is to be installed. In an embodiment, the uncompressed chord length 843 can have a value in a range of from 100 percent to 150 percent of a compressed air tank 150 inner diameter 914. The expansion clover 840 can have an installed chord length of 917 which can be equal to or less than tank section 155 ID 914. In an embodiment, chord length 917 can have a value which accommodates one or a plurality of cushion members or pads.

The cushion member 750 can be made from a broad variety of materials. In an embodiment, the cushion member can be a resilient member. In an embodiment, the resilient member can be a silicone. In a non-limiting example, the resilient member, can be a silicone, a high-temperature silicone, rubber, felt, cloth, polymer, vinyl, plastic, foam molded plastic, cured resin or metal. Other material which the cushion member can have at least in part include but are not limited to paint, coating or wood.

In an embodiment, the stopper 805 or cushion member 750 withstand a temperature in a range of from −40° F. to 600° F. without experiencing any permanent negative changes to essential physical properties related to cushioning when the stopper or cushion is returned from an elevated temperature to an ambient temperature. The cushion member can withstand an elevated temperature in a range of from 380° F. to 410° F.; or from 400° F. to 450° F.; or from 380° F. to 500° F.; or from −40° F. to 750° F.

The expansion clover 840 can be made from a broad variety of materials. In an embodiment, the expansion clover 840 can be made from steel. In a non-limiting example, the expansion clover 840 can have a spring steel at least in part. An example of a spring steel is AISI 1075 spring steel. The thickness 818 (FIG. 26D) of the expansion clover 840 can be a value in a wide range, such as from 0.01 in to 0.5 in. For example, the thickness can be 0.025 in, or 0.04 in, or 0.05 in, or 0.1 in, or 0.2 in. In a non-limiting example, the expansion clover 840 can be 13 gauge (0.090 inch).

In an embodiment, pads or partial pads can be used which have the same or different durometers can be used to provide cushioning and dampen vibration. In an embodiment, a pad under a pressure of 100 psig or less can have a thickness of from 0.05 in to 6 in. In an embodiment, a pad can have a 70 durometer and 0.125 in thick silicone. In an embodiment, a pad can have a 70 durometer and 0.25 thick silicone. In an embodiment, a multi-layered pad can be used with a vibration absorber, e.g. expansion clover 840. This disclosure is not limited to a number of layers, the pad can be from 1 . . . n layers with n being a large number, such as 100. The multi-layered pad can be a laminate of layers and/or a number of layers of materials stacked upon one another, or optionally can have one or more materials adhered together. The layers can be made from the same material, or different materials.

The cushion material can be resilient or non-resilient. In an embodiment, a multi-layered pad can have resilient and non-resilient materials. Optionally, a multi-layered pad can have one or more resilient layers. Optionally, a multi-layered pad can have one or more resilient layers.

FIG. 27 illustrates an expansion clover 840 in an installed state. When the expansion clover 840 is being inserted into position in compressed gas tank 150, it is in a compressed state 993. Once inserted, the force on the compression notches 841 of the expansion clover 840 can be released allowing the expansion clover 840 to expand to an installed state 995. When installed, the expansion clover 840 can have an installed chord length 917, which is equal to or less than the ID 914 of the vessel into which it is inserted. In an embodiment, the installed chord length 917 can be less than the inner diameter ID 914 allowing for the use of one or a plurality of a cushion members 750 which can be placed between the expansion clover 840 and the tank inner surface 151.

Optionally, the expansion clover 840 can exert pressure against the tank inner surface 151 and/or against the one or the plurality of a cushion member 750.

In an embodiment, multiple cushions can be placed between tank inner surface 151 and the expansion clover 840. In an embodiment, a plurality of felt cushions can be used between the, vibration absorber and tank inner surface 151.

In an embodiment, the expansion clover 840 or other vibration absorber can be over-molded with a resilient and/or cushion material. For example, the expansion clover 840 or other vibration absorber can be over-molded with a vibration dampening material. The over-molded expansion clover can have a spring steel and an over-molded cushion. Optionally, the over-molded expansion clover can have a plurality of cushions 750. FIG. 27 illustrates the over-molded expansion clover having a plurality of compression notches 841. The compression notch of the expansion clover can be used to allow a compression tool or other means of applying compression force 1107 (FIG. 26E) to compress the expansion clover 840 for installation inside the vessel. The expansion clover can be compressed from an uncompressed width of 1043 to a compressed width of 1041.

In an embodiment, at least a portion of the outer surface of the compressed gas tank 150 can be wrapped with a sheet of vinyl damping material. In an embodiment, the compressed gas tank 150 can have vibration reduced by, for example, wrapping the compressed gas tank 150 at least in part with a sheet of vinyl damping material, placing a pad on (over) at least a portion of the outer surface of the compressed gas tank 150 and/or by coating at least a portion of its inner surface and/or outer surface.

In an embodiment, at least a portion of the inner or outer surface of the compressed gas tank 150 can be wrapped with a sheet of PVC vinyl, such as polyvinylchloride, having a density of 1 g/cc and a thickness of 0.125 inch. The sheet can be of an unsupported type and can be secured to the tank by an acrylic adhesive having a thickness of 0.03 inches. The sheet can have a dampening performance which can have a value in a range of from 0.10 (e.g. at −1.8 C) to 0.37 (e.g. at 18 C). As an example, a PVC sheet, can be product DM-400-00-00-97 by Technicon Acoustics, 4412 Republic Ct. Concord, N.C. 28027 (Phone: 704-788-1131).

The total tank-side surface area of a tank dampening pad can be a value equal to or less than the outside surface area of the compressed gas tank 150. In an embodiment, the total tank-side surface area of a tank dampening pad can be a value equal to or less than one half of the outside surface area of the compressed gas tank 150. In an embodiment, the total tank-side surface area of a tank dampening pad can be a value equal to or less than one third of the outside surface area of the compressed gas tank 150. For example, in further embodiments, the total tank-side surface area of a tank dampening pad can be a value in a range from 6.0 in^2 to 3000 in^2; or from 8.0 in^2 to 1500 in^2; or from 500 in^2 to 1000 in^2; or from 150 in^2 to 400 in^2; or from 7.2 in^2 to 49.5 in^2; or from 12.5 in^2 to 36.5 in^2; or 13.5 in^2; or 250 in^2.

In an embodiment, at least a portion of the inner or outer surface of the compressed gas tank can be coated with a damping coating. In an embodiment, the coating can be a sprayable viscoelastic polymer. The coating can have a wet density of 13 lb/gal and can have a dry density of 8.5 lb/gal. A thickness having a value in a range of from 0.02 to 0.06 inches can be used. A noise reduction in a value of from 7 to 17 decibels can be achieved through the use of a sprayable viscoelastic. In an example, a sprayable viscoelastic coating can be QuietCoat 118 by Serious Materials, 2002-2011 Serious Energy Inc. 1250 Elko Drive Sunnyvale, Calif. 94089.

An accelerometer can be attached to a tank shell to measure the vibration of the compressed gas tank. As shown in the above embodiments, pressure can be applied to the inside or the outside of the compressed gas tank 150 by a broad variety of means to achieve noise reduction and vibration dampening. In a further embodiment, pressure can be applied to both the inside and outside of the compressed gas tank 150.

The scope of this disclosure is to be broadly construed. It is intended that this disclosure disclose equivalents, means, systems and methods to achieve the devices, designs, operations, control systems, controls, activities, mechanical actions, fluid dynamics and results disclosed herein. For each mechanical element or mechanism disclosed, it is intended that this disclosure also encompasses within the scope of its disclosure and teaches equivalents, means, systems and methods for practicing the many aspects, mechanisms and devices disclosed herein. Additionally, this disclosure regards a compressor and its many aspects, features and elements. Such an apparatus can be dynamic in its use and operation. This disclosure is intended to encompass the equivalents, means, systems and methods of the use of the compressor assembly and its many aspects consistent with the description and spirit of the apparatus, means, methods, functions and operations disclosed herein. The claims of this application are likewise to be broadly construed.

The description of the inventions herein in their many embodiments is merely exemplary in nature and, thus, variations that do not depart from the gist of the invention are intended to be within the scope of the invention and the disclosure herein. Such variations are not to be regarded as a departure from the spirit and scope of the invention.

It will be appreciated that various modifications and changes can be made to the above described embodiments of a compressor assembly as disclosed herein without departing from the spirit and the scope of the following claims.

We claim:

1. A method of controlling, sound emitted from a compressor assembly, comprising the steps of:

providing a compressor assembly having a compressed air tank;

providing a vibration absorber which exerts a force upon the compressed air tank; and controlling the sound level of the compressor assembly when in a compressing state to a value in a range of from 65 dBA to 75 dBA, wherein the step of providing a vibration absorber comprises the vibration absorber exerting a continuous expansive force upon an interior surface of the compressed air tank.

2. The method of controlling sound emitted from a compressor assembly according to claim 1, further comprising the step of:

compressing air at a rate in a range of from 2.4 SCFM, to 3.5 SCFM.

3. The method of controlling sound emitted from a compressor assembly according to claim 1, further comprising the step of:

operating a motor which drives a pump assembly at a pump speed at a rate in a range of from 1500 rpm to 3000 rpm.

4. The method of controlling sound emitted from a compressor assembly according to claim 1, further comprising the step of:

cooling the compressor assembly with a cooling gas at a rate in the range of from 50 CFM to 100 CFM.

5. The method of controlling sound emitted from a compressor assembly according to claim 1, further comprising the step of:

compressing air to a pressure in a range of from 150 psig to 250 psig.

6. A means for controlling the sound level of a compressed air tank, comprising:

a means for absorbing vibration from the compressed air tank, the means for absorbing vibration adapted to exert a continuous expansive pressure upon an interior surface of the compressed air tank.

7. The means for controlling the sound level of a compressed an tank according to claim 6, further comprising:

the means for absorbing vibration from the compressed air tank, which exerts a pressure on a portion of the compressed air tank in a range of from 45 psi to 60 psi.

8. The means for controlling the sound level of a compressed air tank according to claim 6, further comprising:

the means for absorbing vibration from the compressed air tank, which exerts a pressure on the interior surface of the compressed air tank in a range of from 45 psi to 60 psi.

9. The means for controlling the sound level of a compressed air tank according- to claim 6, wherein the means for absorbing vibration from the compressed air tank has a cushion member.

10. The means for controlling the sound level of a compressed air tank according to claim 6, wherein the means for absorbing vibration from the compressed air tank has a multi-layered cushion member.

11. The means for controlling the sound level of a compressed air tank according to claim 6, wherein the means for absorbing vibration from the compressed air tank has a compressive portion.

* * * * *